US008875777B2

(12) United States Patent
Ondrovic et al.

(10) Patent No.: US 8,875,777 B2
(45) Date of Patent: Nov. 4, 2014

(54) STRIP CASTING APPARATUS FOR RAPID SET AND CHANGE OF CASTING ROLLS

(71) Applicant: Nucor Corporation, Charlotte, NC (US)

(72) Inventors: Jay Jon Ondrovic, Brownsburg, IN (US); Eric Fulbright, Paragould, AR (US); Katsumi Nakayama, Tokyo (JP)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/798,914

(22) Filed: Mar. 13, 2013

(65) Prior Publication Data

US 2013/0186587 A1 Jul. 25, 2013

Related U.S. Application Data

(62) Division of application No. 13/310,467, filed on Dec. 2, 2011, which is a division of application No. 12/050,987, filed on Mar. 19, 2008.

(51) Int. Cl.
*B22D 11/06* (2006.01)
*B22D 41/12* (2006.01)

(52) U.S. Cl.
CPC ..... *B22D 11/0622* (2013.01); *B22D 41/12* (2013.01); *B22D 11/0697* (2013.01)
USPC ..... 164/428; 164/415; 164/475; 164/480

(58) Field of Classification Search
USPC ..... 164/415, 428, 475, 480
See application file for complete search history.

(56) References Cited

U.S. PATENT DOCUMENTS 3,273,208 A 9/1966 Greenberger
3,837,894 A 9/1974 Tucker
4,376,661 A 3/1983 Takechi et al.
4,398,970 A 8/1983 Marder
4,436,561 A 3/1984 Takahashi et al.
4,609,410 A 9/1986 Hu
4,708,748 A 11/1987 Satoh et al.

(Continued)

FOREIGN PATENT DOCUMENTS

CN 1942362 4/2007
DE 3009680 B1 8/1980

(Continued)

OTHER PUBLICATIONS

Search Report for AU2008903230, Aug. 22, 2008.

(Continued)

*Primary Examiner* — Keith Walker
*Assistant Examiner* — Kevin E Yoon
(74) *Attorney, Agent, or Firm* — Hahn, Loeser & Parks LLP; Arland T. Stein

(57) ABSTRACT

A method of continuously casting steel strip includes steps of providing rails positioned beneath a casting position and extending in opposite directions there from to discharge stations, supporting first and second scrap receptacles movable along the rails, engaging a seal between the first scrap receptacle and an enclosure enabling support of a protective atmosphere beneath a pair of casting rolls, disengaging the seal between the first scrap receptacle and the enclosure and moving the first scrap receptacle along the rails in a direction away from the second scrap receptacle to a discharge station, and moving the second scrap receptacle into the casting position and sealingly engaging the second scrap receptacle and the enclosure.

10 Claims, 15 Drawing Sheets

(56) References Cited

U.S. PATENT DOCUMENTS

| | | | | |
|---|---|---|---|---|
| 4,770,719 | A | 9/1988 | Hashiguchi et al. | |
| 5,191,927 | A | 3/1993 | Terado et al. | |
| 5,328,528 | A | 7/1994 | Chen | |
| 5,470,403 | A | 11/1995 | Yoshinaga et al. | |
| 5,706,882 | A | 1/1998 | Fellus et al. | |
| 5,787,967 | A | 8/1998 | Vendeville et al. | |
| 5,816,311 | A | 10/1998 | Osada et al. | |
| 5,960,855 | A | 10/1999 | Assefpour-Dezfully et al. | |
| 5,960,856 | A | 10/1999 | Blejde et al. | |
| 6,044,895 | A | 4/2000 | Kuttner et al. | |
| 6,164,366 | A | 12/2000 | Fish | |
| 6,167,942 | B1 | 1/2001 | Fish | |
| 6,167,943 | B1 | 1/2001 | Fish | |
| 6,210,496 | B1 | 4/2001 | Takagi et al. | |
| 6,312,536 | B1 | 11/2001 | Omiya | |
| 6,382,107 | B1 | 5/2002 | Schmitz et al. | |
| 6,397,924 | B1 | 6/2002 | Fish et al. | |
| 6,408,222 | B1 | 6/2002 | Kim et al. | |
| 6,423,426 | B1 | 7/2002 | Kobayashi et al. | |
| 6,440,584 | B1 | 8/2002 | Nagataki et al. | |
| 6,536,504 | B2 * | 3/2003 | Takeuchi et al. | 164/415 |
| 6,537,394 | B1 | 3/2003 | Osawa et al. | |
| 6,575,225 | B1 | 6/2003 | Hohenbichler | |
| 6,641,931 | B2 | 11/2003 | Claessens | |
| 6,673,171 | B2 | 1/2004 | Hlady | |
| 6,676,774 | B2 | 1/2004 | Matsuoka et al. | |
| 6,702,904 | B2 | 3/2004 | Kami et al. | |
| 6,706,419 | B2 | 3/2004 | Yoshinaga et al. | |
| 6,709,535 | B2 | 3/2004 | Utsumi et al. | |
| 6,739,384 | B2 | 5/2004 | Schoen et al. | |
| 6,776,218 | B2 | 8/2004 | Glutz | |
| 6,811,624 | B2 | 11/2004 | Hoydick | |
| 6,814,819 | B2 | 11/2004 | Matsuoka et al. | |
| 6,818,074 | B2 | 11/2004 | Matsuoka et al. | |
| 6,837,301 | B2 | 1/2005 | Nikolovski | |
| 6,869,691 | B2 | 3/2005 | Nagataki et al. | |
| 6,886,623 | B2 | 5/2005 | Kato et al. | |
| 6,942,013 | B2 | 9/2005 | Strezov | |
| 6,988,530 | B2 | 1/2006 | Nikolovski | |
| 7,073,565 | B2 | 7/2006 | Nikolovski et al. | |
| 7,118,809 | B2 | 10/2006 | Utsumi | |
| 7,140,416 | B2 * | 11/2006 | Bassarutti et al. | 164/428 |
| 7,311,789 | B2 | 12/2007 | Hoydick | |
| 7,381,478 | B2 | 6/2008 | Yokoi et al. | |
| 7,396,420 | B2 | 7/2008 | Matsuoka et al. | |
| 7,442,268 | B2 | 10/2008 | Sun | |
| 7,464,746 | B2 | 12/2008 | Edwards | |
| 7,534,312 | B2 | 5/2009 | Yoshinaga et al. | |
| 2003/0041932 | A1 | 3/2003 | Tosaka et al. | |
| 2003/0084966 | A1 | 5/2003 | Ikeda et al. | |
| 2003/0129444 | A1 | 7/2003 | Matsuoka et al. | |
| 2004/0003774 | A1 | 1/2004 | Moore | |
| 2004/0035500 | A1 | 2/2004 | Ikeda et al. | |
| 2004/0047756 | A1 | 3/2004 | Rege et al. | |
| 2004/0079514 | A1 | 4/2004 | Strezov et al. | |
| 2004/0108024 | A1 | 6/2004 | Matsuoka et al. | |
| 2004/0206471 | A1 * | 10/2004 | Blejde et al. | 164/428 |
| 2004/0238080 | A1 | 12/2004 | Vandeputte et al. | |
| 2004/0238082 | A1 | 12/2004 | Hasegawa et al. | |
| 2005/0016644 | A1 | 1/2005 | Matsuoka et al. | |
| 2005/0019601 | A1 | 1/2005 | Matsuoka et al. | |
| 2006/0118270 | A1 | 6/2006 | Zahedi et al. | |
| 2006/0118271 | A1 * | 6/2006 | Cooper et al. | 164/480 |
| 2006/0191612 | A1 | 8/2006 | Yoshida et al. | |
| 2007/0003774 | A1 | 1/2007 | McDaniel | |
| 2007/0158046 | A1 | 7/2007 | Cooper et al. | |
| 2008/0220955 | A1 | 9/2008 | Hesse et al. | |
| 2009/0049882 | A1 | 2/2009 | Flick et al. | |
| 2009/0090484 | A1 | 4/2009 | d'Hone et al. | |

FOREIGN PATENT DOCUMENTS

| | | | |
|---|---|---|---|
| EP | 0726112 | | 6/1999 |
| EP | 0969112 | A1 | 1/2000 |
| EP | 191114 | A1 | 3/2002 |
| EP | 1291448 | A1 | 3/2003 |
| EP | 0947261 | | 11/2004 |
| EP | 1529582 | | 5/2005 |
| GB | 1501902 | | 2/1978 |
| JP | 60-145253 | | 7/1985 |
| JP | 4066247 | A1 | 3/1992 |
| JP | 8029401 | B2 | 3/1996 |
| JP | 10109150 | A | 4/1998 |
| JP | 11090588 | A | 4/1999 |
| JP | 2000237858 | A | 9/2000 |
| JP | 2004074185 | | 3/2004 |
| JP | 2006187792 | A | 7/2006 |
| KR | 20020017028 | A | 3/2002 |
| WO | 0021816 | | 4/2000 |
| WO | 0126847 | | 4/2001 |
| WO | 0139914 | | 6/2001 |
| WO | 0211924 | | 2/2002 |
| WO | 03023074 | | 3/2003 |
| WO | 2004007113 | | 1/2004 |

OTHER PUBLICATIONS

Supplementary European Search Report for EP09721535, 05-22-212.

The First Office Action for CN200980115397.6, Sep. 12, 2012.

Machine translation of Japanese Patent Publication No. 2004-074185.

International Search Report for PCT/AU20091000314, May 18, 2009.

Extended European Search Report for EP10177174.9, May 16, 2012.

Extended European Search Report for EP09721535.4, May 22, 2012.

* cited by examiner

STRIP CASTING APPARATUS FOR RAPID SET AND CHANGE OF CASTING ROLLS

This application is a divisional of U.S. patent application Ser. No. 13/310,467 filed Dec. 2, 2011, which is a divisional of U.S. patent application Ser. No. 12/050,987 filed Mar. 19, 2008, the disclosure of both of which are incorporated herein by reference.

BACKGROUND AND SUMMARY

This invention relates to the casting of metal strip by continuous casting in a twin roll caster.

In a twin roll caster molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

There are portions of the caster requiring service during operation. After being in operation for a duration, the texture on the casting rolls may diminish and lose its effectiveness, or other adverse conditions may develop, increasing or reducing the heat transfer through the casting roll surface. In this event, the flow of molten metal is halted, and the casting rolls may be replaced with a new or reconditioned pair of casting rolls. When the casting rolls are replaced, other portions of the metal delivery system may be replaced. Further, a scrap receptacle is positioned beneath the caster, and may fill up during operation of the caster. When the scrap receptacle fills, the full scrap receptacle may be moved away and an empty scrap receptacle put in place. The time it takes to replace these and other items cumulate in a change-over time. As the twin roll caster is not casting metal at least during portions of the change-over time, it is desired to reduce the change-over time.

An apparatus is disclosed for continuously casting thin steel strip comprising:

(a) a pair of counter-rotatable casting rolls having casting surfaces laterally positioned to form a nip there between through which thin cast strip can be cast, and on which a casting pool of molten metal can be formed supported on the casting surfaces above the nip;

(b) the casting rolls mounted in a roll cassette capable of being transferred from a set up station to a casting position through a transfer station, where at the set up station the casting rolls mounted in the roll cassette are capable of being prepared for casting, at the transfer station roll cassettes with the mounted casting rolls are capable of being exchanged, and in the casting position the casting rolls mounted in the roll cassette are operational in the caster; and (c) casting roll guides adapted to enable movement of the casting rolls mounted in the roll cassette between the set up station and the transfer station and between the transfer station and the casting position.

The casting roll guides may be adapted to enable movement of the casting rolls mounted in the roll cassette from the set up station to the casting position through the transfer station at substantially the same elevation. Alternately or in addition, the first and second rails may be adapted to enable movement of the casting rolls mounted in the roll cassette between the set up station and the transfer station at a different elevation than moving the casting rolls from the transfer stations to the casting position.

The casting roll guides may comprise rails on which the casting rolls mounted in the roll cassette are capable of being moved between the set up station and the casting position through the transfer station. First rails extend between the set up station to the transfer station, second rails extend between the transfer station to the casting position, and both first and second rails are capable of being aligned with rails on a turntable of the transfer station such that the turntable may be turned to exchange casting rolls mounted in roll cassettes between the first rails and the second rails. The first and second rails may be adapted to enable movement of the casting rolls mounted in the roll cassette from the set up station to the casting position through the transfer station at substantially the same elevation or at different elevations.

At the casting position, the casting rolls are moved into operating position for casting of thin strip. This movement of the casting rolls into operating position may be by raising, lowering or lateral motion of the casting rolls. This movement of the casting rolls into operating position may be by movement of the casting rolls and the roll cassette as a unit, or by moving the casting rolls separate from at least part of roll cassette. This movement will generally depend on the particular embodiment desired, but the movement will be generally as little as practical so as to reduce motion and time in positioning the casting rolls in operating position. The operating position may be as the casting rolls reach the casting position without change in elevation or lateral motion.

The apparatus for continuously casting thin steel strip may include an enclosure capable of supporting a protective atmosphere immediately beneath the casting rolls in the casting position; and an upper cover capable of moving between a closed position covering an upper portion of the enclosure and a retracted position enabling cast strip to be cast downwardly from the nip into the enclosure. Guides, such as a pair of rails, may be provided adapted to enable movement of the upper cover between the closed position and the retracted position. A plurality of actuators may be selected from the group consisting of servo-mechanisms, hydraulic mechanisms, pneumatic mechanisms, and rotating actuators capable of moving the upper cover along the guides between the closed position and the retracted position.

The apparatus may include an upper collar portion movable between an extended position in sealing engagement to support a protective atmosphere immediately beneath the casting rolls in the casting position and an open position enabling the upper cover to move into its closed position. A plurality of actuators selected from the group consisting of servo-mechanisms, hydraulic mechanisms, pneumatic mechanisms, and rotating actuators are provided capable of moving the upper collar between the extended position and the open position.

In addition, a housing portion may be positioned adjacent the casting rolls capable of supporting a protective atmosphere immediately beneath the casting rolls in the casting position, and a knife seal positioned adjacent each casting roll and adjoining the housing portion and forming a partial closure between the housing portion and the rotating casting rolls.

The apparatus for continuously casting steel strip may further comprise at least one scrap receptacle capable of being positioned beneath the casting rolls in the casting position and movable in either direction away from the casting position on a scrap receptacle guide to discharge stations, each scrap receptacle capable of attaching with the enclosure capable of supporting a protective atmosphere immediately beneath the casting rolls in the casting position. The scrap receptacle guide may comprise rails extending in opposite directions from the casting position, the rails capable of supporting at least two scrap receptacles movable along the rails from the casting position to the discharge stations.

Further, the apparatus for continuously casting steel strip may include a rim portion capable of sealingly engaging an upper portion of the scrap receptacle positioned beneath the casting position. The apparatus may further include a lower plate operatively positioned within the enclosure capable of closing a lower portion of the enclosure when the rim portion is disengaged from the scrap receptacle. The lower plate may have two portions pivotably mounted to move into a closed position. A plurality of actuators selected from the group consisting of servo-mechanisms, hydraulic mechanisms, pneumatic mechanisms, and rotating actuators may be provided capable of moving the lower plate between the closed position and a retracted position.

The apparatus for continuously casting thin steel strip may further comprise:

(d) a movable tundish capable of being transferred from a heating station to the casting position and capable of receiving molten metal and transferring the molten metal to the casting pool through a distributor and a core nozzle when in the casting position, and (e) a tundish guide adapted to enable movement of the movable tundish from the heating station where the movable tundish is capable of being heated to an operative temperature to the casting position.

The tundish guide may comprise rails extending between the heating station and the casting position. Further, the movable tundish may be capable of being movable in either direction away from the casting position via the tundish guide.

Additionally, a loading device may be provided capable of moving the distributor from a stand-by position to the casting position. At least a portion of the loading device may be overhead from the elevation of the distributor positioned in the casting position. The loading device may be a loading arm movable with the movable tundish on the tundish guide and capable of lifting the distributor from the stand-by position and placing the distributor over the casting rolls in the casting position.

A method of continuously casting steel strip is disclosed comprising the steps of:

(a) assembling a first pair of counter-rotatable casting rolls mounted in a roll cassette having casting surfaces laterally positioned to form a nip there between through which thin cast strip can be cast, and on which a casting pool of molten metal may be formed supported on the casting surfaces above the nip, (b) preparing the first casting rolls mounted in a roll cassette for casting at a set up station;

(c) moving the first casting rolls mounted in a roll cassette to a transfer station;

(d) moving the first casting rolls mounted in a roll cassette from the transfer station to casting position where the pair of counter-rotatable casting rolls is positioned for casting thin strip.

The method of continuously casting steel strip may further comprise the steps:

(e) exchanging at the transfer station the first casting rolls mounted in a roll cassette with a second casting rolls mounted in a second roll cassette, and (f) moving the second casting rolls mounted in a second roll cassette from the transfer station to the set up station where the second casting rolls can be changed (i.e., placed, repaired or refurbished).

In the method of continuously casting steel strip, the moving of first and second roll cassettes with casting rolls mounted thereon between the set up station and the casting position may be done on rails, with first rails extending between the set up station and the transfer station, second rails extending between the transfer station and the casting position, and the first and second rails capable of being aligned with rails on a turntable at the transfer station such that the turntable may be turned to exchange casting rolls mounted in roll cassettes between the first set of rails and the second set of rails. The first and second casting rolls mounted in roll cassettes can be moved between the set up station and the casting position through the transfer station at substantially the same elevation or different elevations.

A method of continuously casting steel strip is disclosed using a pair of counter-rotatable casting rolls mounted in a roll cassette having casting surfaces laterally positioned to form a nip there between through which thin cast strip can be cast, and on which a casting pool of molten metal can be supported on the casting surfaces above the nip, the improvement providing for rapid exchange of casting rolls comprising the steps of:

(a) providing an enclosure capable of supporting a protective atmosphere immediately beneath the casting rolls in the casting position having an upper cover capable of moving between a retracted position and a closed position beneath the casting rolls and covering the enclosure;

(b) moving the upper cover to the retracted position enabling cast strip to be cast downwardly from the nip into the enclosure; and (c) moving the upper cover to the closed position retaining the protective atmosphere in the enclosure and enabling the casting rolls to be removed from the casting position.

The method of continuously casting steel strip may comprise in addition locating at least one scrap receptacle capable of being positioned beneath the casting rolls and the enclosure in the casting position and movable in either direction away from the casting position by scrap receptacle guides to discharge stations, each scrap receptacle capable of attaching with the enclosure capable of supporting a protective atmosphere immediately beneath the casting rolls in the casting position.

The method may include engaging an upper collar portion adjacent to the casting rolls to support the protective atmosphere in the enclosure beneath the casting rolls, and disengaging the upper collar portion to enable the upper cover to be moved into the closed position. The method may also include engaging a seal between a scrap receptacle and the enclosure to support the protective atmosphere in the enclosure beneath the casting rolls. Additionally, the method may include the step of closing the lower portion of the enclosure when the seal is disengaged from the scrap receptacle to enable casting to continue during change of the scrap receptacle, if desired.

The method of continuously casting steel strip may also include positioning rails to form the scrap receptacle guides in opposite directions from the casting position, the rails capable of supporting at least two scrap receptacles movable along the rails from the casting position to the discharge stations away from the caster, and may include sealing an upper portion of a scrap receptacle in sealing engagement with an enclosure supporting a protective atmosphere beneath the casting position.

The method of continuously casting steel strip may comprise in addition, moving a movable tundish, which is capable of receiving molten metal and transferring the molten metal to the casting pool through a distributor and a core nozzle, from a heating station to a casting position via a tundish guide elevated above the movement of the first casting rolls mounted in a roll cassette from the heating station to the casting position.

The guide may comprise rails extending between the heating station and the casting position.

The method of continuously casting steel strip may include providing a loading device with the movable tundish capable of moving the distributor from a stand-by position and placing the distributor over the casting rolls in the casting position, the loading device being elevated above the movement of the first casting roll mounted in a roll cassette; advancing the movable tundish from the heating station to the casting position; and moving the distributor from the stand-by position and placing the distributor over the casting rolls in the casting position.

Alternately, a method of continuously casting steel strip may comprise steps of:

(a) providing rails positioned beneath a casting position and extending in opposite directions there from to discharge stations;
(b) supporting first and second scrap receptacles movable along the rails;
(c) sealingly engaging the first scrap receptacle with an enclosure enabling support of a protective atmosphere beneath a pair of casting rolls;
(d) disengaging the seal between the first scrap receptacle and the enclosure and moving the first scrap receptacle along the rails in a direction away from the second scrap receptacle to a discharge station; and
(e) moving the second scrap receptacle into the casting position and sealingly engaging the second scrap receptacle and the enclosure.

The method may include filling the second scrap receptacle with a desired protective gas before moving the second scrap receptacle into the casting position.

The method of continuously casting steel strip may further comprise:

(f) preparing the first casting rolls mounted in a roll cassette for casting at a set up station;
(g) moving the first casting rolls mounted in a roll cassette from the set up station to a transfer station;
(h) exchanging at the transfer station the first casting rolls mounted in a roll cassette with second casting rolls mounted in a second roll cassette;
(i) moving the first casting rolls mounted in a roll cassette from the transfer station to the casting position where the first pair of counter-rotatable casting rolls are positioned for casting thin strip; and
(j) moving the second casting rolls mounted in a second roll cassette from the transfer station to the set up station where the second casting rolls can be changed.

The method of continuously casting thin steel strip may comprise in addition, moving a movable tundish, which is capable of receiving molten metal and transferring the molten metal to the casting pool through a distributor and a core nozzle, from a heating station to a casting position by a tundish guide elevated above the movement of the first and second casting rolls in roll cassettes from the transfer station to the casting position.

The tundish guide may comprise rails extending between the heating station and the casting position. The method may further include providing a loading device with the movable tundish capable of moving the distributor from a stand-by position and placing the distributor over the casting rolls in the casting position, the loading device elevated above the movement of the first and second casting rolls; advancing the movable tundish from the heating station to the casting position; and positioning the distributor from a stand-by position and placing the distributor over the casting rolls in the casting position.

DETAILED DESCRIPTION OF THE DRAWINGS

Figure 1:
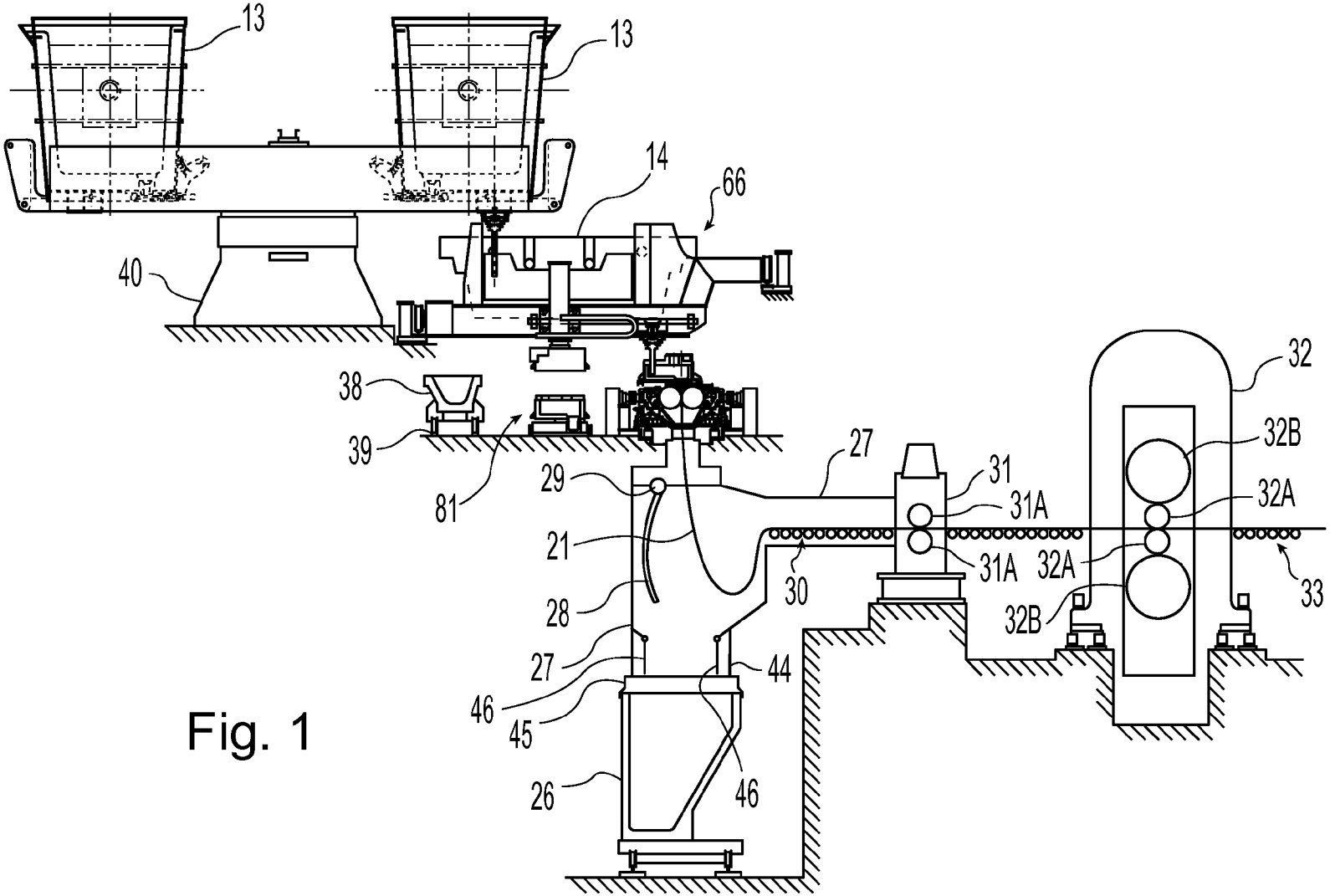
FIG. 1 is a diagrammatical side view of a twin roll caster of the present disclosure.

Referring now to FIGS. 1 through 7, a twin roll caster is illustrated that comprises a main machine frame 10 that stands up from the factory floor and supports a pair of casting rolls mounted in a module in a roll cassette 11. The casting rolls 12 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

The casting apparatus for continuously casting thin steel strip includes a pair of counter-rotatable casting rolls 12 having casting surfaces 12A laterally positioned to form a nip 18 there between. Molten metal is supplied from a ladle 13 through a metal delivery system to a metal delivery nozzle 17, or core nozzle, positioned between the casting rolls 12 above the nip 18. Molten metal thus delivered forms a casting pool 19 of molten metal above the nip supported on the casting surfaces 12A of the casting rolls 12. This casting pool 19 is confined in the casting area at the ends of the casting rolls 12 by a pair of side closures or side dam plates 20 (shown in dotted line in FIG. 3). The upper surface of the casting pool 19 (generally referred to as the "meniscus" level) may rise above the lower end of the delivery nozzle 17 so that the lower end of the delivery nozzle is immersed within the casting pool. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station 69, where the tundish is heated to near a casting temperature, to the casting position. A tundish guide 70 positioned beneath the tundish car 66 to enable moving the movable tundish 14 from the heating station 69 to the casting position.

Figure 11:
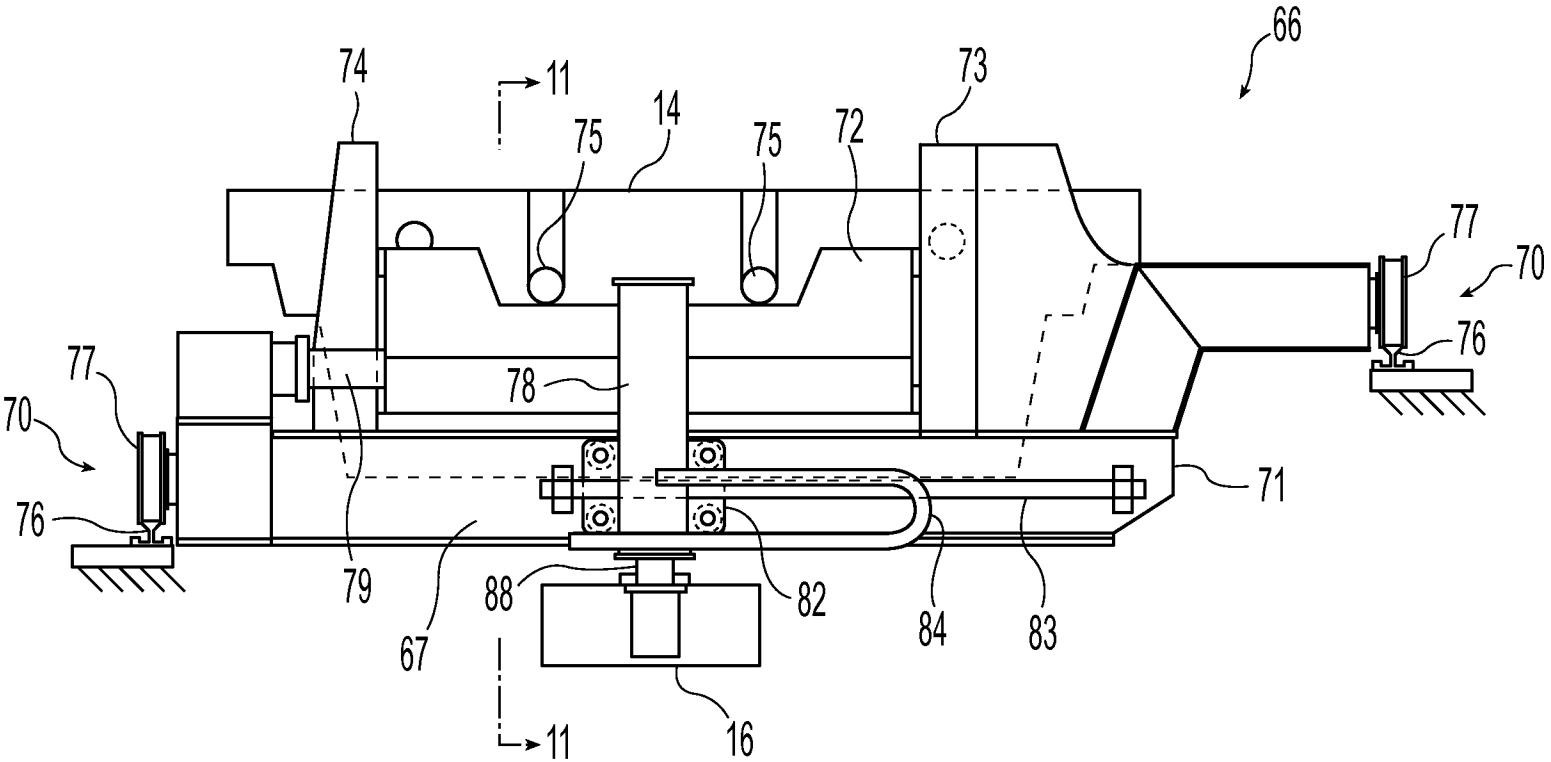
FIG. 11 is a diagrammatical side view of a movable tundish of the present disclosure.
Figure 12:
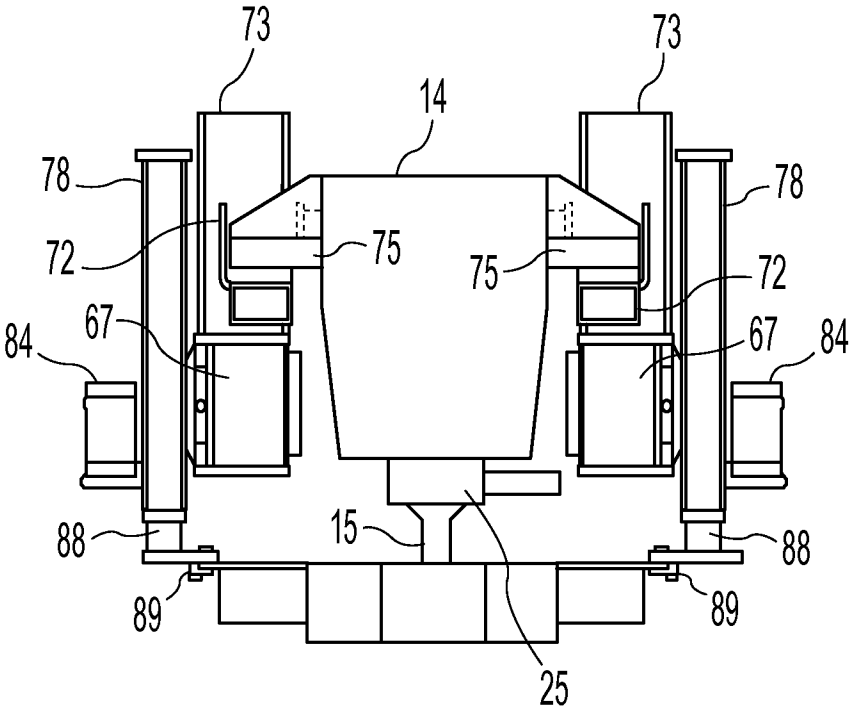
FIG. 12 is a diagrammatical end view of the movable tundish of FIG. 11.
Figure 13:
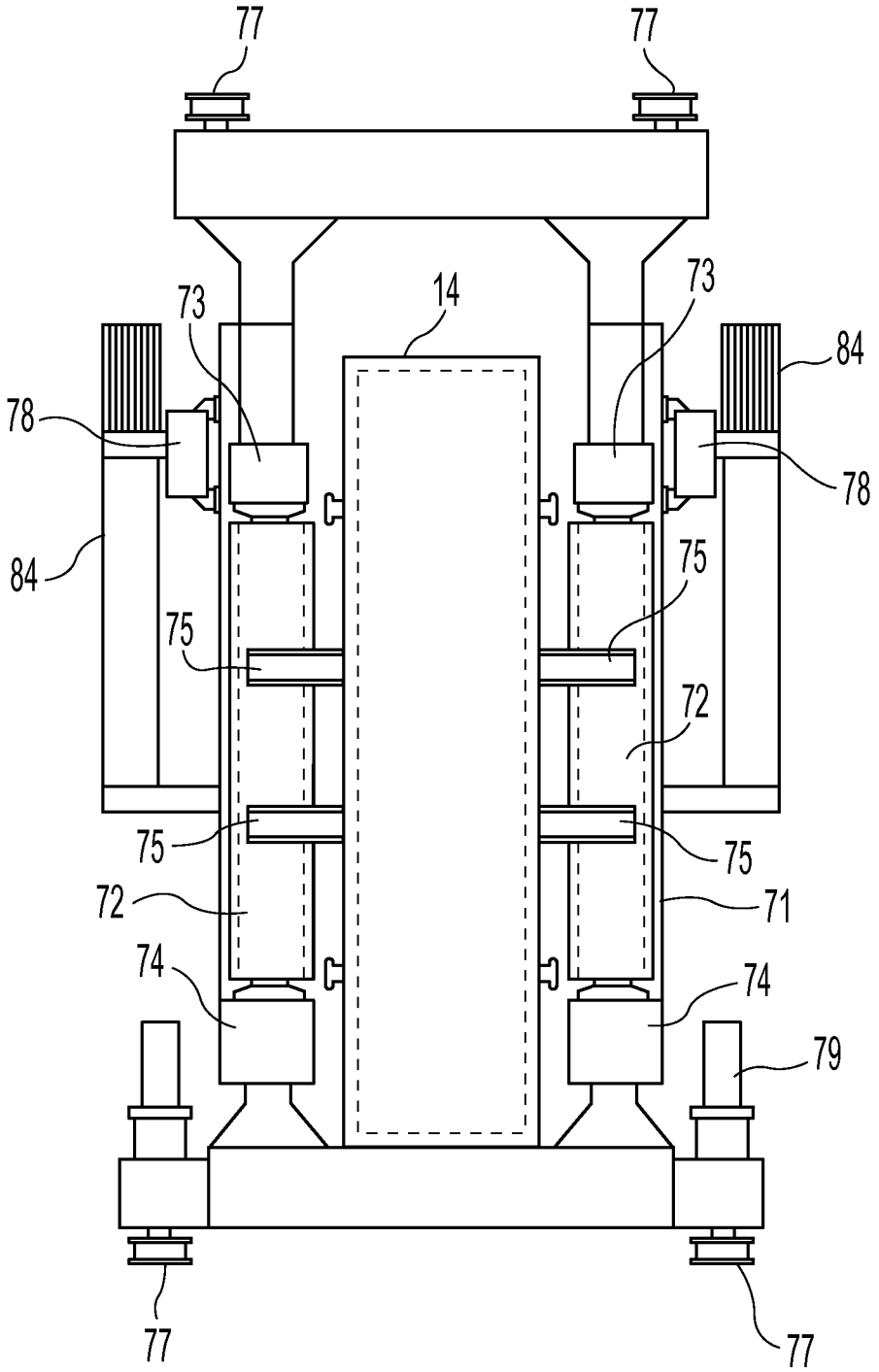
FIG. 13 is a diagrammatical plan view of the movable tundish of FIG. 11.

As shown in FIGS. 11 through 13, the tundish car 66 may include a frame 71 having a tundish support beam 72 engaging tundish arms 75 on each side of the tundish 14. The tundish support beams 72 may be positioned between lifters 73, 74 capable of raising and lowering the tundish support beam 72 and the tundish 14 relative to the frame 71 to position the tundish 14 on the tundish car 66.

Figure 2:
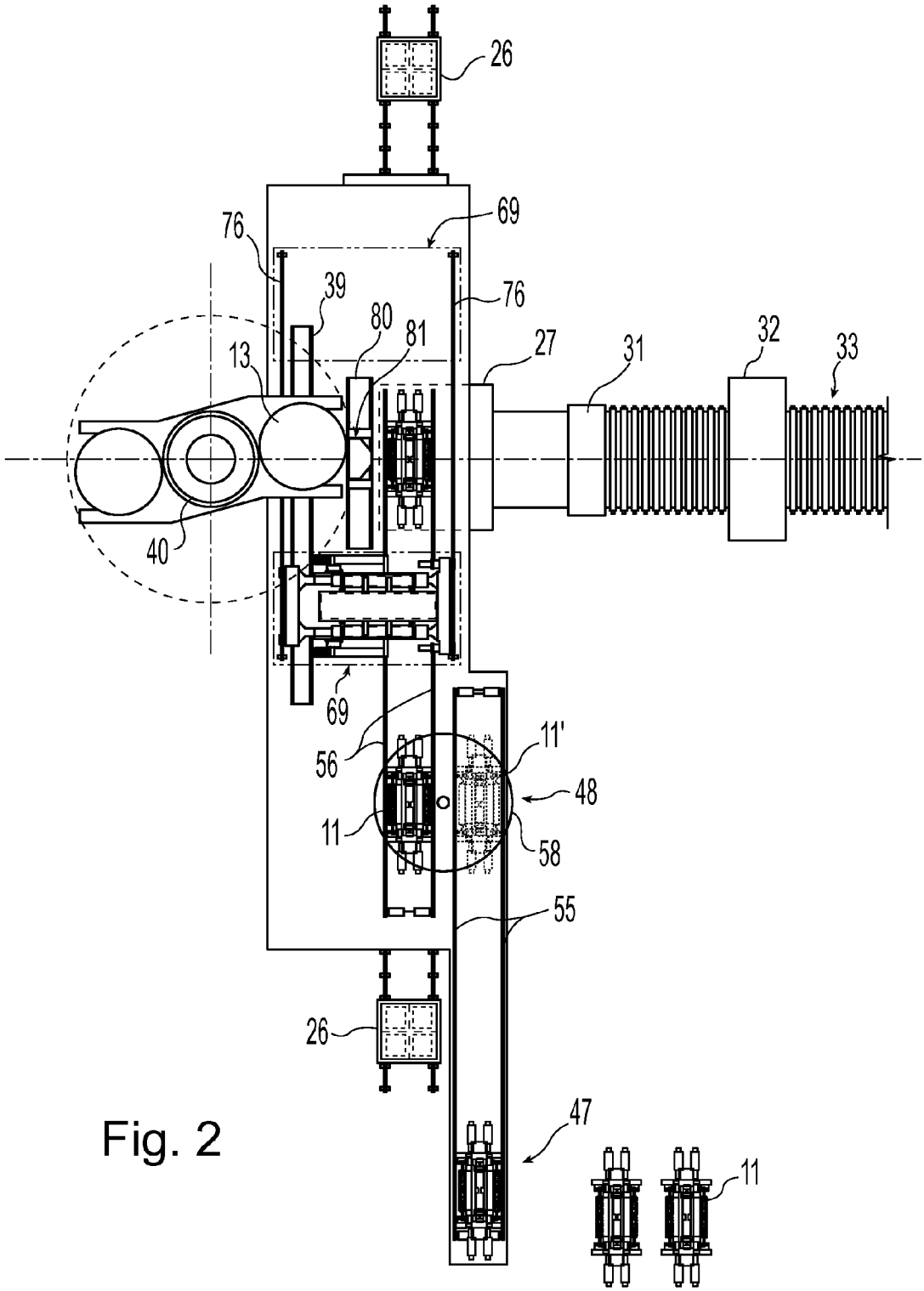
FIG. 2 is a diagrammatical plan view of the twin roll caster of FIG. 1.

The tundish guide may include rails 76 extending between the heating station and the casting position, and the tundish car 66 may include wheels 77 assembled to move on the rails 76. One or more drive motors 79 may be used to drive the wheels 77 along the rails. As shown in FIG. 2, the rails 76 may extend between two heating stations 69 in either direction away from the casting position, and capable of supporting two tundish cars 66, so that one tundish car may be in one of the heating stations 69 while another tundish car is in the casting position. After casting is stopped, the tundish 14 in the casting position may be moved on the first tundish car in the direction away from the second tundish car to its respective heating station. The tundish car typically moves between the casting position to the heating station at an elevation above the casting rolls 12 mounted in roll cassette 11, and at least a portion of the tundish guide 70 may be overhead from the elevation of the casting rolls 12 mounted in roll cassette 11 for movement of the tundish between the heating station and the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought together at the nip 18 between the casting rolls to produce a solidified thin cast strip product 21 delivered downwardly from the nip. FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of reduction rolls 32A and backing rolls 32B, where the cast strip is hot rolled to reduce the strip to a desired thickness, improve the strip surface, and improve the strip flatness. The rolled strip then passes onto a run-out table 33, where it may be cooled by contact with water supplied via water jets or other suitable means, not shown, and by convection and radiation. In any event, the rolled strip may then pass through a second pinch roll stand (not shown) to provide tension of the strip, and then to a coiler.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIGS. 1 and 2, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

Figure 10:
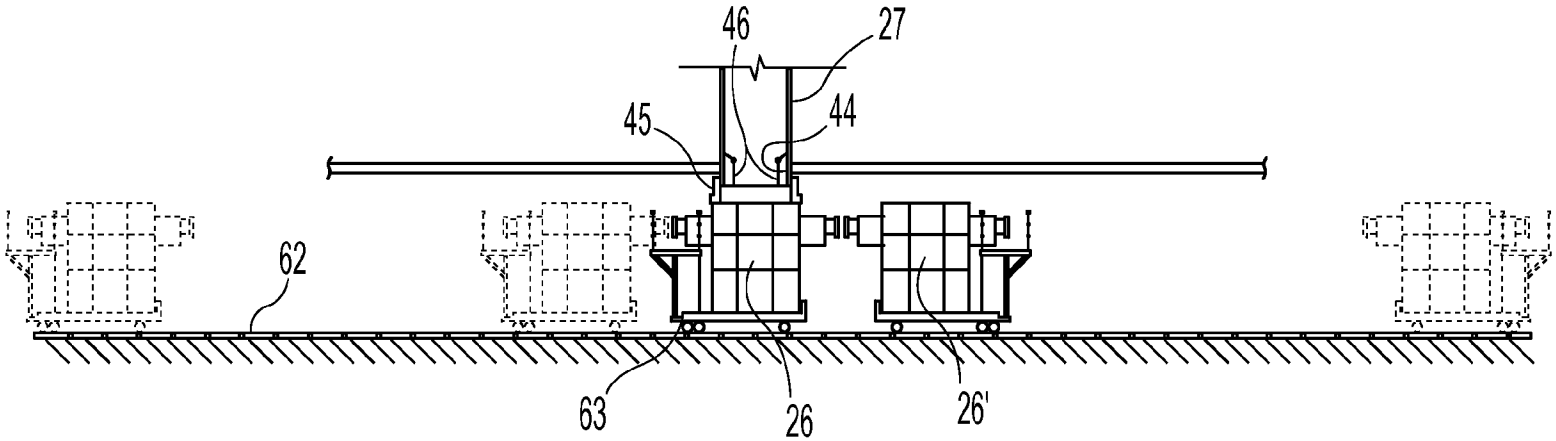
FIG. 10 is a diagrammatical partial side view of the scrap receptacle guide and scrap receptacles.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the enclosure 27. As shown in FIGS. 1 and 10, the rim portion may be movable away from or otherwise disengage from the scrap receptacle to disengage the seal and allow the scrap receptacle to move from the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position.

Figure 4:
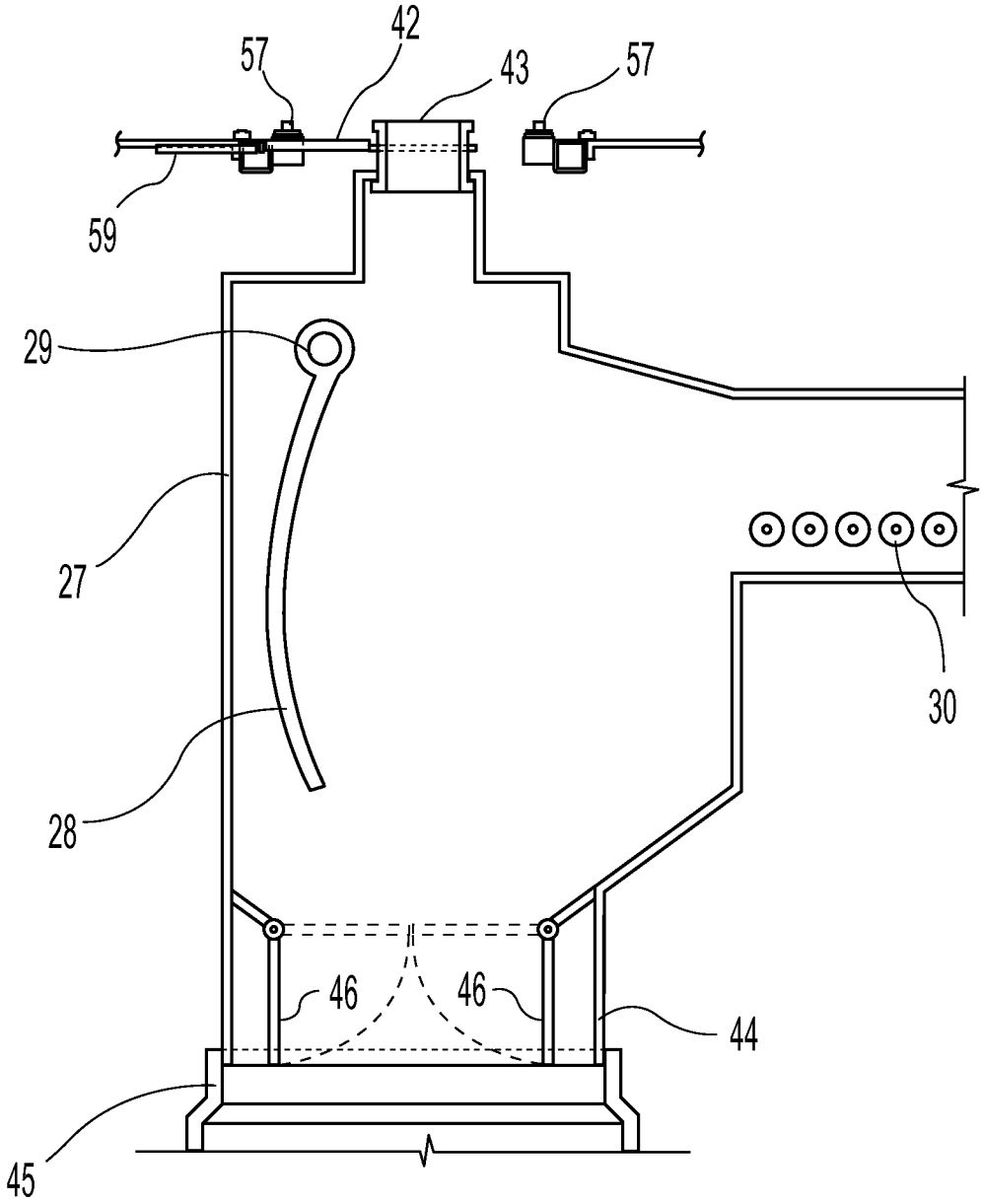
FIG. 4 is a partial sectional view of an enclosure of the twin roll caster of FIG. 1.

A lower plate 46 may be operatively positioned within or adjacent the lower enclosure portion 44 to permit further control of the atmosphere within the enclosure when the scrap receptacle 26 is moved from the scrap receiving position and provide an opportunity to continue casting while the scrap receptacle is being changed for another. The lower plate 46 may be operatively positioned within the enclosure 27 capable of closing the opening of the lower portion of the enclosure, or lower enclosure portion 44, when the rim portion 45 is disengaged from the scrap receptacle. Then, the lower plate 46 may be retracted when the rim portion 45 sealingly engages the scrap receptacle to enable scrap material to pass downwardly through the enclosure 27 into the scrap receptacle 26. As shown in FIGS. 1 and 4, the lower plate 46 may be in two plate portions, pivotably mounted to move between a retracted position and a closed position. Alternately, the lower plate 46 may be one moveable plate portion. A plurality of actuators (not shown) such as servo-mechanisms, hydraulic mechanisms, pneumatic mechanisms and rotating actuators may be suitably positioned outside of the enclosure 27, and capable of moving the lower plate in whatever configuration between a closed position and a retracted position. The plurality of actuators may be provided to rotate the lower plate 46 about a pivot. Alternately, the lower plate 46 may be movable laterally along a guide, such as one or more rails between a closed position closing the lower enclosure portion 44 and a retracted position enabling scrap material to pass downwardly through the enclosure 27 into the scrap receptacle 26.

As shown in FIG. 10, a scrap receptacle is placed beneath the casting position in the scrap receiving position to receive scrap and other by-products of the casting process in the receptacle during casting. When the scrap receptacle 26 is in the scrap receiving position, the rim portion 45 of the enclosure wall is in sealing engagement with the upper edges of the scrap receptacle 26 and the lower plate 46 is retracted. The rim portion 45 engages a portion of the scrap receptacle 26, sealingly engaging the enclosure 27. When sealed, the enclosure 27 and scrap receptacle 26 are filled with a desired gas, such as nitrogen, to reduce the amount of oxygen in the enclosure and provide a protective atmosphere for the cast strip.

Figure 3:
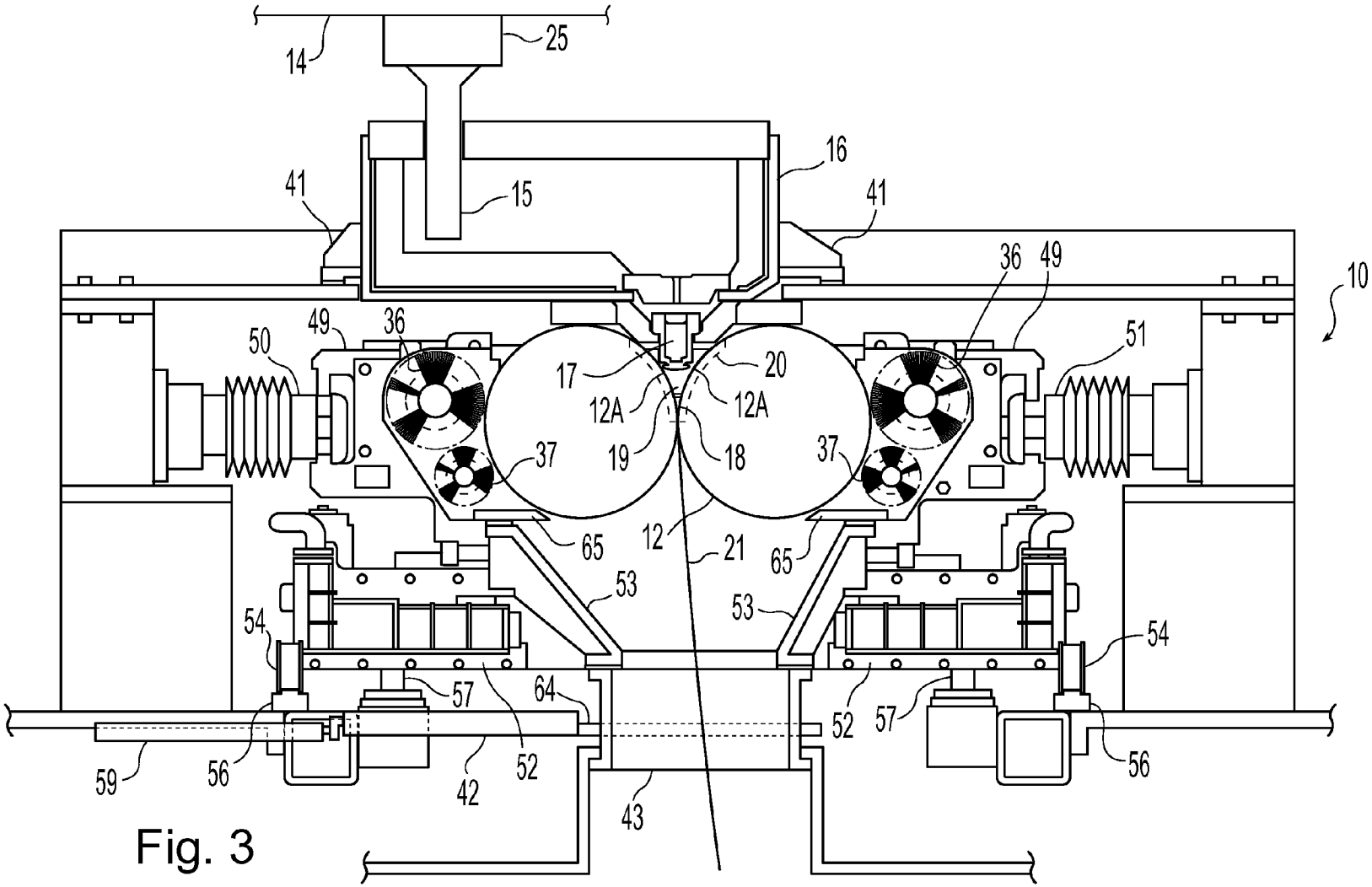
FIG. 3 is a partial sectional view through casting rolls mounted in a roll cassette in the casting position of the present disclosure.
Figure 7:
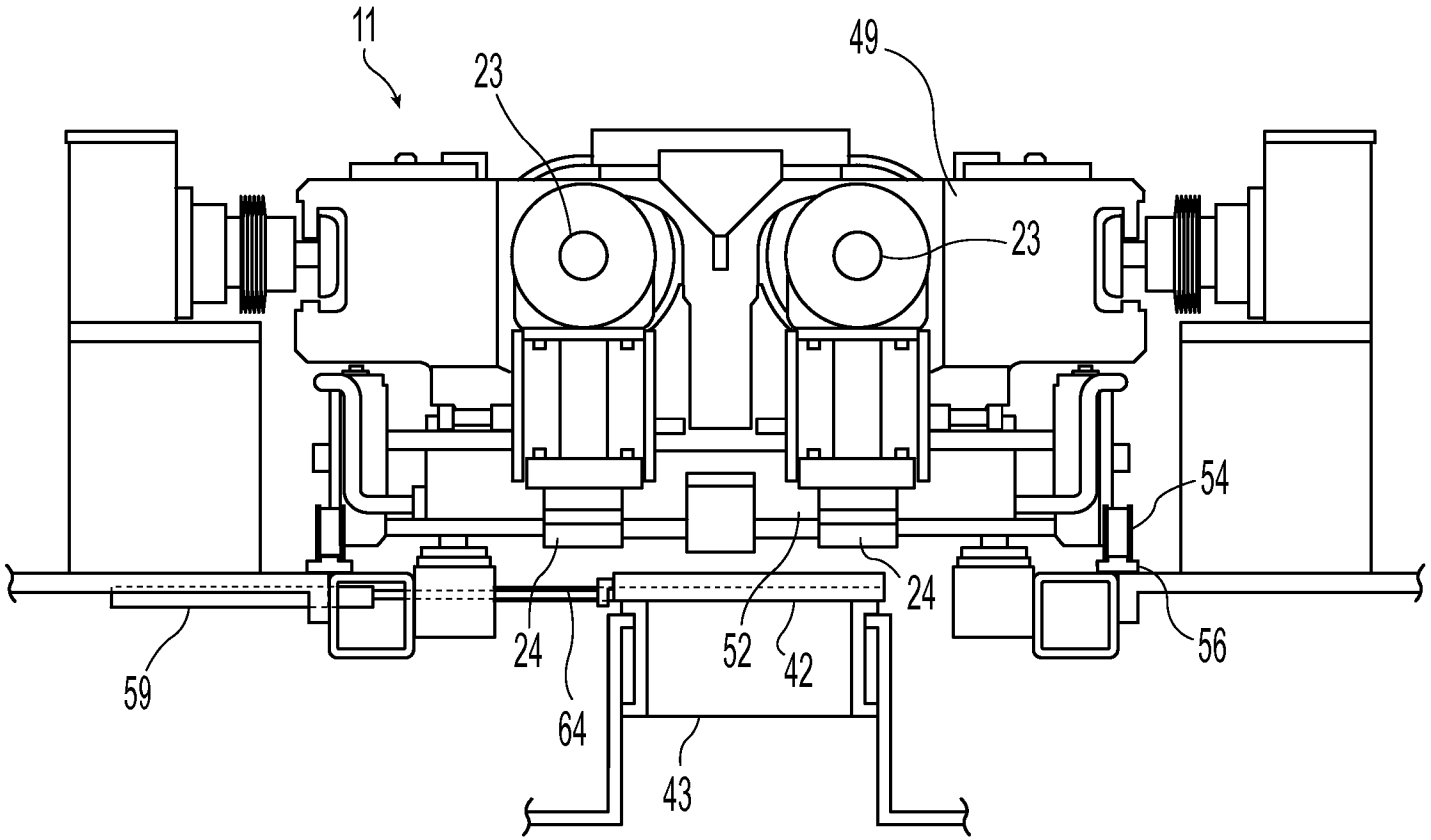
FIG. 7 is a diagrammatical end view of the casting rolls mounted in a roll cassette of FIG. 3 in the casting position.

The enclosure 27 may include an upper collar portion 43 supporting a protective atmosphere immediately beneath the casting rolls in the casting position. As shown in FIGS. 3 and 7, the upper collar portion 43 may be moved between an extended position capable of supporting the protective atmosphere immediately beneath the casting rolls and an open position enabling an upper cover 42 to cover the upper portion of the enclosure 27. When the roll cassette 11 is in the casting position, the upper collar portion 43 is moved to the extended position closing the space between a housing portion 53 adjacent the casting rolls 12, as shown in FIG. 3, and the enclosure 27. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators. The actuators are positioned outside of the enclosure 27 and capable of moving the upper collar portion 43 between an extended and an open position. The upper collar portion 43 may be raised into the extended position in sealing engagement with the housing portion 53, which may or may not be part of the roll cassette 11, and be able to support the protective atmosphere in enclosure 27 immediately beneath the casting rolls in the casting position. The upper collar position 43 may also be lowered into the open position disengaged from housing portion 53 enabling the upper cover 42 to move into its closed position beneath the casting rolls and covering the upper portion of the enclosure 27 as described below. The upper collar portion 43 may be water cooled.

The upper cover 42 may be operatively moved into closed position at the upper portion of the enclosure 27 beneath the casting rolls to permit further control of the protective atmosphere within the enclosure when the casting rolls are removed from the casting position. The upper cover 42 may be operably positioned within or adjacent the upper portion of the enclosure 27 capable of moving between a closed position covering the enclosure and a retracted position enabling cast strip to be cast downwardly from the nip into the enclosure 27. When the upper cover 42 is in the closed position, the roll cassette 11 may be moved from the casting position without significant loss of the protective atmosphere in the enclosure. This enables a rapid exchange of casting rolls, with the roll cassette, since closing the cover 42 enables the protective atmosphere in the enclosure to be preserved so that it does not have to be replaced.

One or more actuators 59, such as servo-mechanisms, hydraulic mechanisms, pneumatic mechanisms, and rotating actuators, may be provided to move the upper cover 42 between the closed position and open position. As shown in FIG. 7, the upper cover in the closed position enables the roll cassette 11 to be moved from the casting position without substantial degradation of the protective atmosphere in the enclosure 27. The upper cover may then be retracted when the casting rolls, typically in the roll cassette 11, are to be moved into the casting position, and the upper collar portion 43 moved to its extended position to support the protective atmosphere in the enclosure 27, as shown in FIG. 3, so that cast strip may be cast downwardly from the nip between the casting rolls and pass into the enclosure 27. As shown in FIGS. 3 and 7, the upper cover 42 may be capable of engaging the upper collar portion 43 and closing the enclosure 27. Alternately, the upper cover 42 may be in two or more portions capable of closing the enclosure 27. The upper cover 42 may be movable laterally along guides, such as a pair of rails 64 as shown in FIGS. 3 and 7, and the actuator 59 capable of moving the upper cover along the guides between the closed position and the retracted position. Alternately the upper cover 42 may rotated about a pivot, or with other motion, to move between a retracted position and a closed position. In any case, the actuator 59 is capable of moving the upper cover between the closed position and the retracted position.

The roll cassette 11 with casting rolls may be assembled in a module for rapid installation in the caster in preparation for casting strip, and for rapid set up of the casting rolls 12 for installation. The roll cassette 11 comprises a cassette frame 52, roll chocks 49 capable of supporting the casting rolls 12 and moving the casting rolls on the cassette frame, and the housing portion 53 positioned beneath the casting rolls capable of supporting a protective atmosphere in the enclosure 27 immediately beneath the casting rolls during casting. The housing portion 53 is positioned corresponding to and sealingly engaging an upper portion of the enclosure 27 for enclosing the cast strip below the nip.

A roll chock positioning system is provided on the main machine frame 10 having two pairs of positioning assemblies 50, 51 that can be rapidly connected to the roll cassette adapted to enable movement of the casting rolls on the cassette frame 52, and provide forces resisting separation of the casting rolls during casting. The positioning assemblies 50, 51 may include actuators such as mechanical roll biasing units or servo-mechanisms, hydraulic or pneumatic cylinders or mechanisms, linear actuators, rotary actuators, magnetostrictive actuators or other devices for enabling movement of the casting rolls and resisting separation of the casting rolls during casting.

Figure 14:
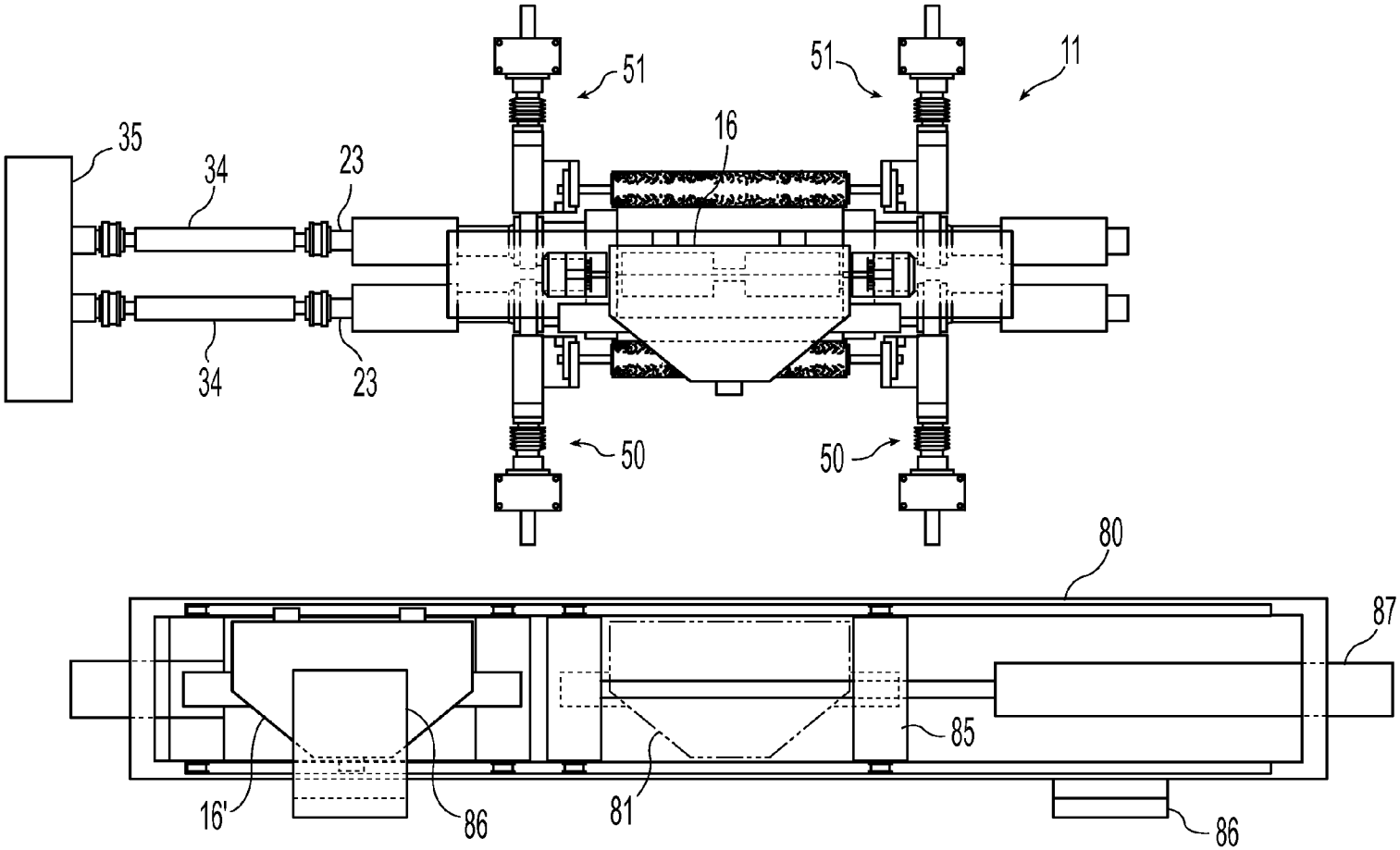
FIG. 14 is a diagrammatical plan view of casting rolls mounted in a roll cassette in a casting position with a distributor shift car.

The casting rolls 12 include shaft portions 22, which are connected to drive shafts 34, best viewed in FIG. 14, through end couplings 23. The casting rolls 12 are counter-rotated through the drive shafts by an electric motor (not shown) and transmission 35 mounted on the main machine frame. The drive shafts can be disconnected from the end couplings 23 when the cassette is to be removed enabling the casting rolls to be changed without dismantling the actuators of the positioning assemblies 50, 51. The casting rolls 12 have copper peripheral walls formed with an internal series of longitudinally extending and circumferentially spaced water cooling passages, supplied with cooling water through the roll ends from water supply ducts in the shaft portions 22, which are connected to water supply hoses 24 through rotary joints (not shown). The casting rolls 12 may be about 500 millimeters in diameter, or may be up to 1200 millimeters or more in diameter. The length of the casting rolls 12 may be up to about 2000 millimeters, or longer, in order to enable production of strip product of about 2000 millimeters width, or wider, as desired in order to produce strip product approximately the width of the rolls. Additionally, the casting surfaces may be textured with a distribution of discrete projections, for example, as random discrete projections as described and claimed in U.S. Pat. No. 7,073,565. The casting surface may be coated with chrome, nickel, or other coating material to protect the texture.

Figure 5:
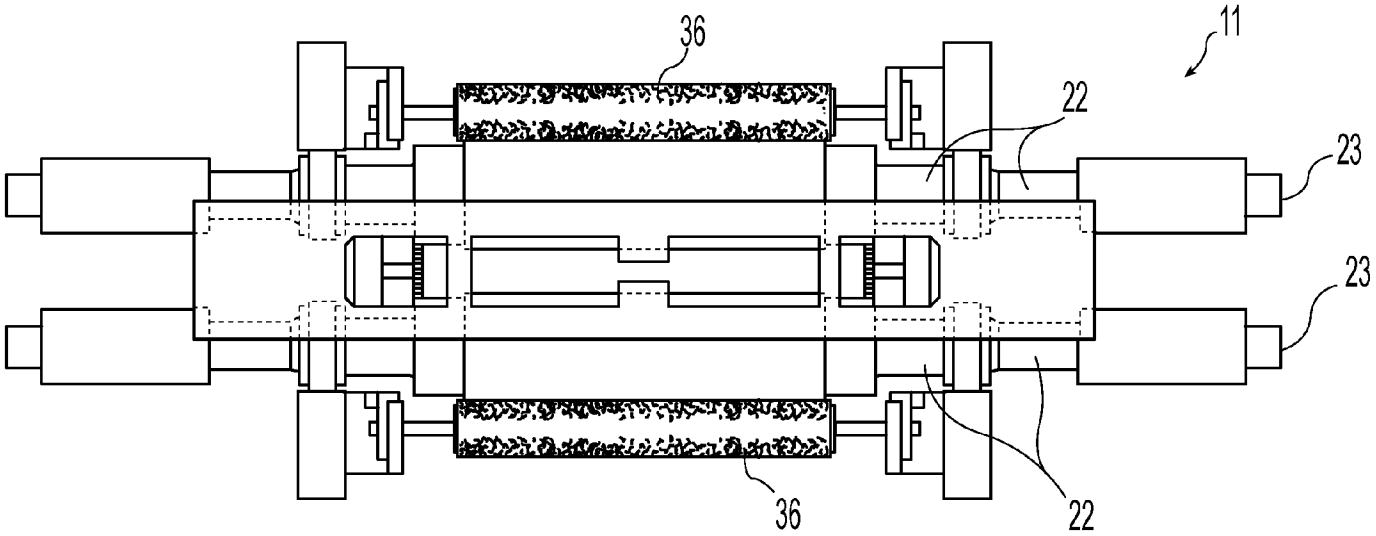
FIG. 5 is a diagrammatical plan view of the roll cassette of FIG. 3 removed from the caster.
Figure 6:
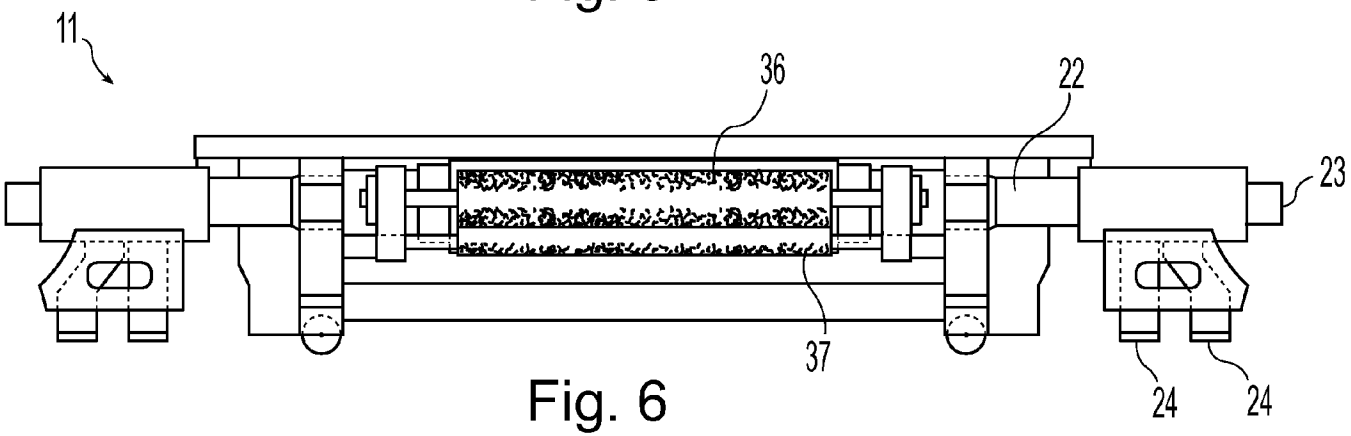
FIG. 6 is a diagrammatical side view of the casting rolls mounted in a roll cassette of FIG. 3 removed from the caster.

As shown in FIGS. 3 and 5, cleaning brushes 36 are disposed adjacent the pair of casting rolls, such that the periphery of the cleaning brushes 36 may be brought into contact with the casting surfaces 12A of the casting rolls 12 to clean oxides from the casting surfaces during casting. The cleaning brushes 36 are positioned at opposite sides of the casting area adjacent the casting rolls, between the nip 18 and the casting area where the casting rolls enter the protective atmosphere in contact with the molten metal casting pool 19. Optionally, a separate sweeper brush 37 may be provided for further cleaning the casting surfaces 12A of the casting rolls 12, for example at the beginning and end of a casting campaign as desired.

A knife seal 65 may be provided adjacent each casting roll 12 and adjoining the housing portion 53. The knife seals 65 may be positioned as desired near the casting roll and forming a partial closure between the housing portion 53 and the rotating casting rolls 12. The knife seals 65 enable control of the atmosphere around the brushes, and reduce the passage of hot gases from the enclosure 27 around the casting rolls. The knife seals 65 may be positioned 3 to 4 millimeters from the casting roll surface 12A, as desired, when in casting position. The position of each knife seal 65 may be adjustable during casting by causing actuators such as hydraulic or pneumatic cylinders to move the knife seal toward or away from the casting rolls. Alternately, the knife seals 65 may be positioned prior to casting and not adjustable during casting.

Once the roll cassette 11 is in the casting position in the caster, the casting rolls 12 are moved into an operating position for casting thin strip. This movement of the casting rolls into operating position may be by raising, lowering or lateral motion of the casting rolls 12. This movement of the casting rolls 12 into operating position may be by movement of the casting rolls 12 and the roll cassette 12 as a unit, or by moving the casting rolls 12 separate from at least part of roll cassette 11. This movement in operating position will generally depend on the particular embodiment desired, but the movement will be generally as little as practical so as to reduce motion and time in getting the casting rolls into operating position. The operating position may be as the casting rolls reach the casting position without change in elevation or lateral motion.

Once in operating position, the casing rolls are secured with the positioning assemblies 50, 51 connected to the roll cassette 11, drive shafts connected to the end couplings 23, and a supply of cooling water coupled to water supply hoses 24. A plurality of jacks 57 may be used to further place the casting rolls in operating position. The jacks 57 may raise the roll cassette 11 in the casting position, as shown in FIG. 3. Alternately, the roll cassette may be lowered or laterally moved in the casting position to place the casting rolls in operating position. The positioning assemblies 50, 51 may move at least one of the casting rolls 12 to provide a desired nip, or gap between the rolls in the casting position.

Each casting roll 12 is mounted in the roll cassette 11 to be capable of moving toward and away from the nip for controlling the casting of the strip product. The positioning assemblies 50, 51 include actuators capable of moving each casting roll toward and away from the nip as desired. Sensors are provided capable of sensing the location of the casting rolls and producing electrical signals indicative of each casting roll's position. A control system is provided capable of receiving the electrical signals indicating the casting roll's position and causing the actuators to move the casting rolls into desired position for casting metal strip. The apparatus for continuously casting strip may have separate actuators capable of moving each casting roll independently.

Figure 15:
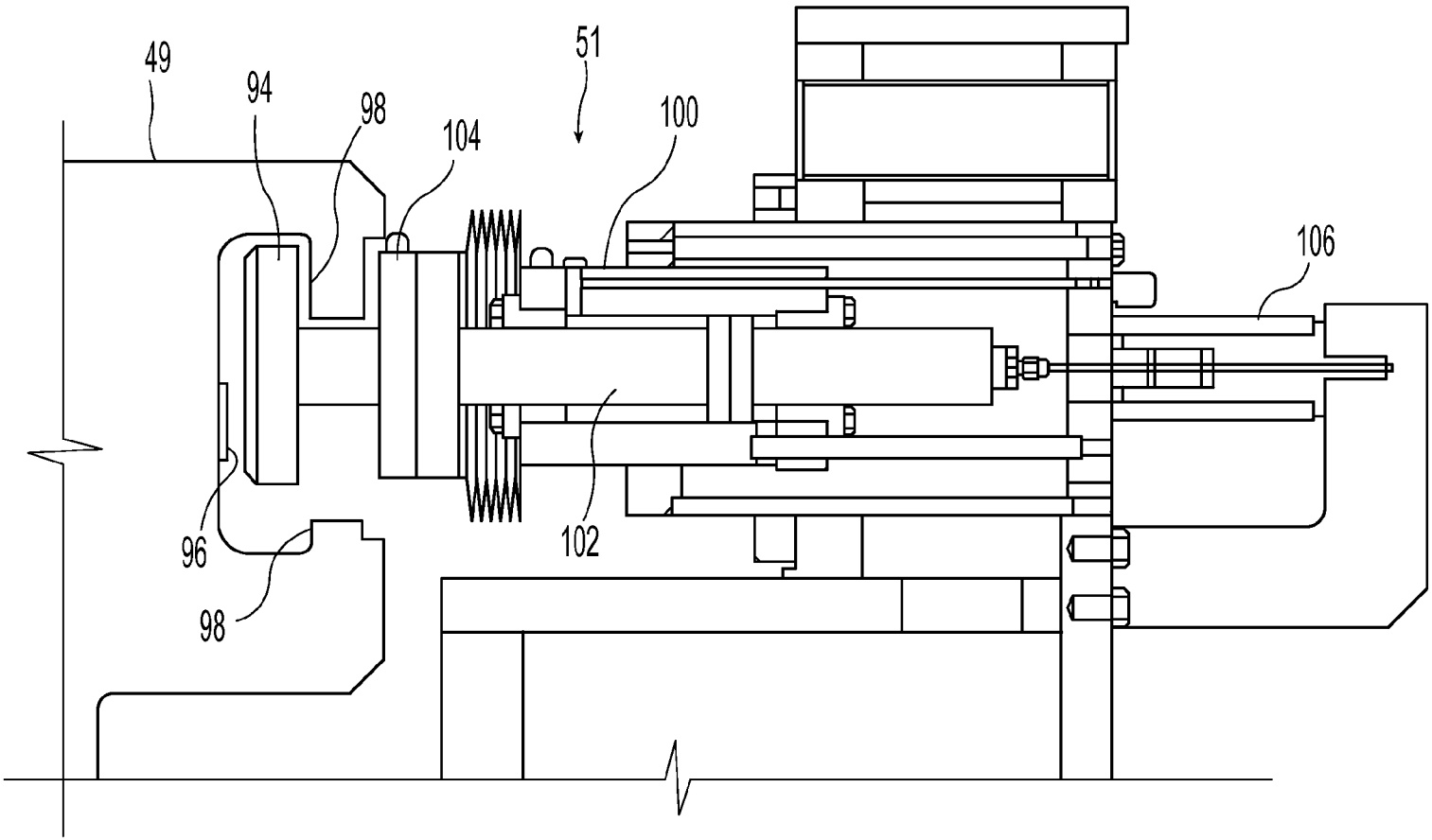
FIG. 15 is a sectional view through a first positioning assembly of the present disclosure in the retracted position of FIG. 7.
Figure 16:
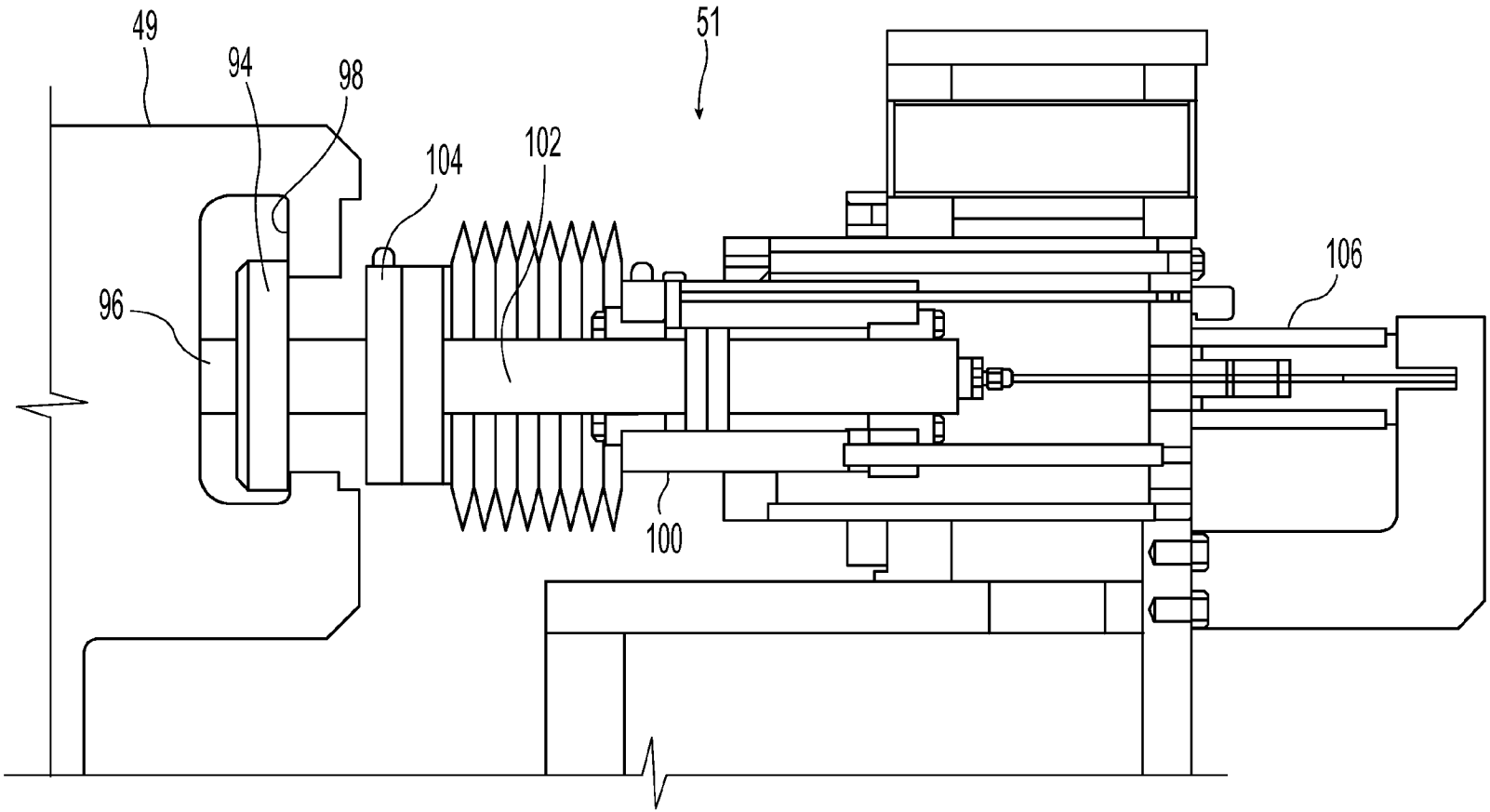
FIG. 16 is a sectional view through the positioning assembly of FIG. 15 in the extended position of FIG. 3.

As shown in FIGS. 15 and 16, the positioning assembly 51 may have a flange 94 capable of engaging the roll cassette 11 to move the casting rolls 12. The positioning assembly 51 may be secured to the roll cassette in cooperation with shaft 96. The shaft 96 may be positioned by an actuator (not shown) moving in and out within the roll chock 49, and secure the positioning assembly 51 by pressing the flange 94 against a corresponding surface 98 of the roll cassette 11.

The positioning assembly 51 includes a first actuator 100. The first actuator 100 may be capable of moving a thrust element 102 in connection with the flange 94. A first position sensor 106 is provided to determine the position of the thrust element 102, and thereby the position of the flange 94 and the roll chock 49 secured thereto. The first position sensor 106 provides signals to the control system indicating the position of the roll chock 49 and associated casting roll 12.

Figure 17:
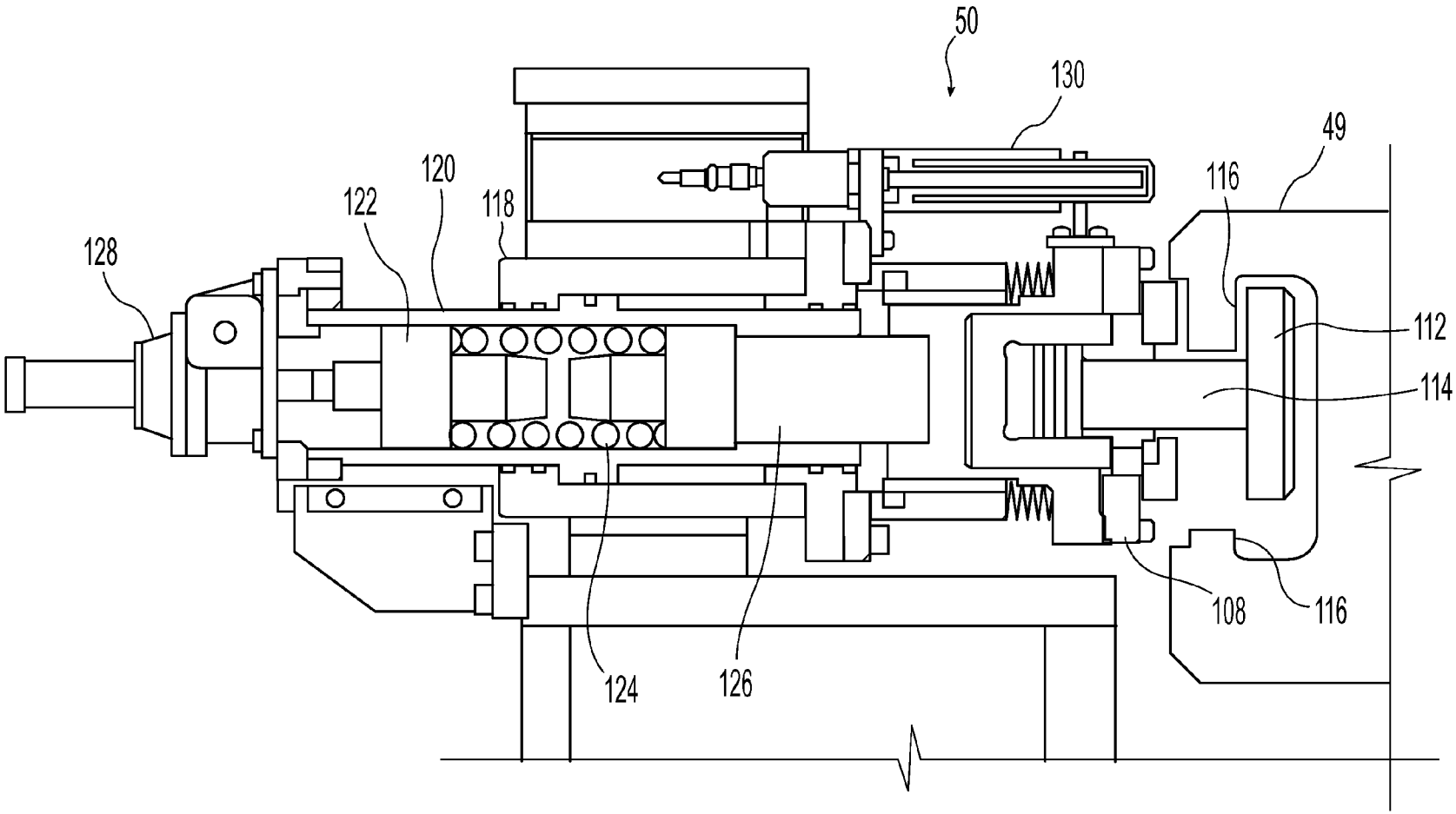
FIG. 17 is a sectional view through a second positioning assembly in the retracted position of FIG. 7.

As shown in FIG. 17, positioning assembly 50 has a flange 112 capable of engaging the roll cassette 11. The positioning assembly 50 may be secured to the roll cassette by a flange cylinder 114. The flange cylinder 114 is engaged to secure the flange 112 against a corresponding surface 116 of the roll cassette 11.

The positioning assembly 50 may include a second actuator 118 capable of moving a thrust element 120 in connection with the flange 112. The thrust element 120 for the positioning assembly 50 may include a spring positioning device 122, a compression spring 124, and a slidable shaft 126 movable against the compression spring 124 within the thrust element 120. A screw jack 128 or other actuator may be provided capable of translating the spring positioning device 122, and thereby advancing the slidable shaft 126 and compressing the compression spring 124. The flange 112 is connected to the slidable shaft 126 and displaceable against the compression spring 124.

A second location sensor 130 may be provided to determine the position of the slidable shaft 126, and thereby the position of the flange 112 and the roll chock 49 secured thereto. The second location sensor 130 provides signals to the control system indicating the position of the roll chock 49 and associated casting roll 12.

The actuators 100, 118 are capable of moving the casting rolls independently to vary the distance between the casting rolls. Additionally, the actuators 100, 118 may be capable of varying the distance between the casting rolls at each end of the casting rolls independently. As shown in FIG. 14, positioning assemblies 50, 51 may be provided for each end of each casting roll to provide roll position control by independently positioning both ends of each casting roll.

Position sensors 106, 130 are capable of sensing the location of the casting rolls 12 and producing electrical signals indicative of each casting roll position. The control system is capable of receiving the electrical signals indicating the casting roll positions and causing the actuators to move the casting rolls 12 into desired position for casting metal strip. The control system may control the position of each end of each casting roll 12 independently by causing the two pair of actuators 100, 118 to vary the distance between the casting rolls at each end of the casting rolls independently.

The control system may include one or more controllers, such as programmable computers, programmable microcontrollers, microprocessors, programmable logic controllers, signal processors, or other programmable controllers capable of receiving electrical signals from the sensors, processing the electrical signals, and providing control signals capable of causing the actuators 100, 118 to move as desired.

Additional profile sensors may be positioned downstream of the nip capable of sensing the strip thickness profile at a plurality of locations along the strip width, and producing electrical signals indicative of the strip thickness profile downstream of the nip. Then, the control system may be capable of processing the electrical signals indicative of the strip thickness profile and causing the actuators to move the casting rolls and further control the thickness profile of the cast strip.

Figure 8:
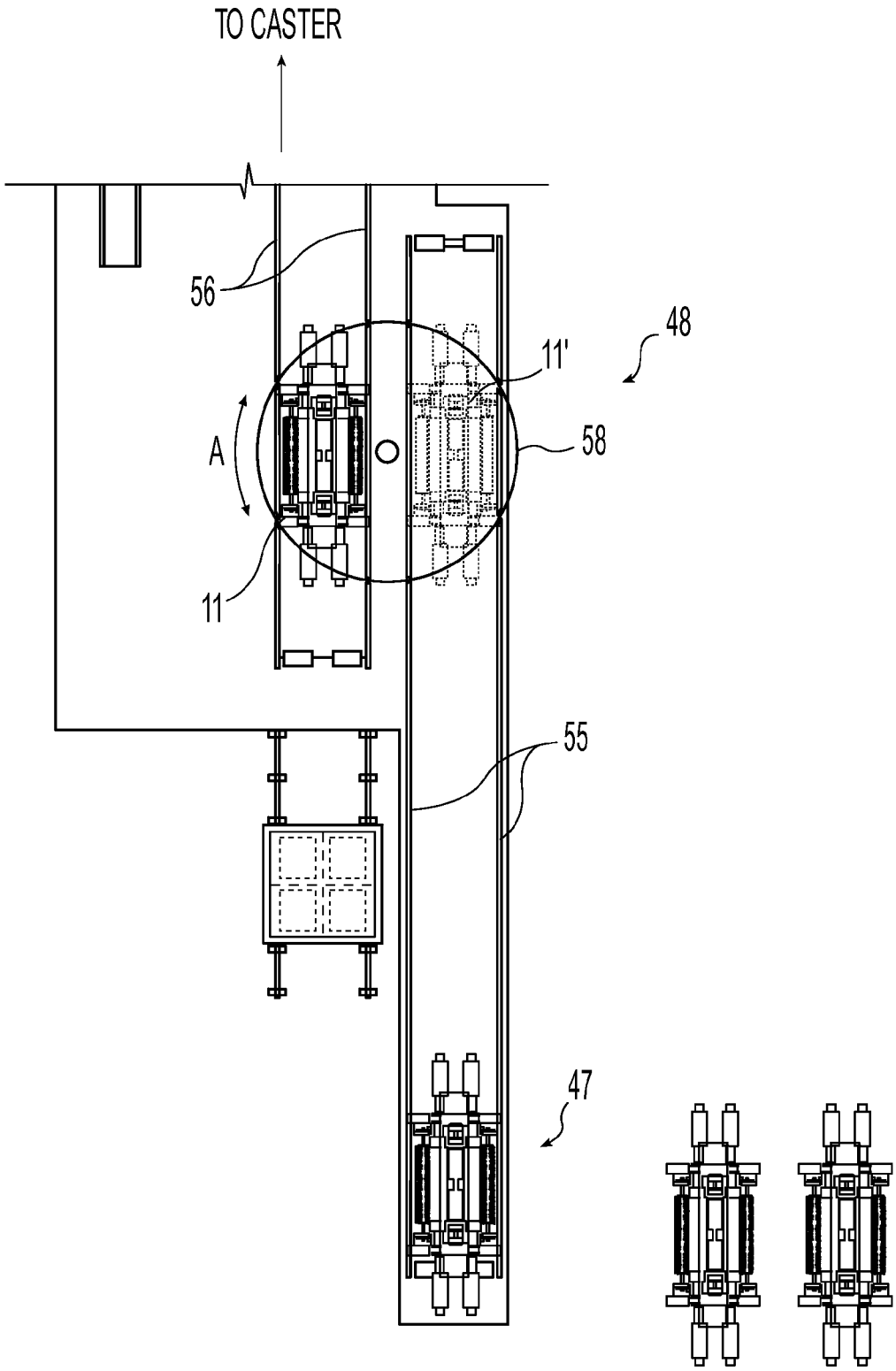
FIG. 8 is a diagrammatical plan view of a casting rolls transfer station and a set-up station of the present disclosure.

The casting rolls 12 mounted in roll cassette 11 are capable of being transferred from a set up station 47 to a casting position through a transfer station 48, as shown in FIGS. 2 and 8. The casting rolls 12 may be assembled into the roll cassette 11 and then moved to the set up station 47, where at the set up station the casting rolls mounted in the roll cassette are capable of being prepared for casting. At the transfer station 48, casting rolls mounted in roll cassettes are capable of being exchanged, and in the casting position the casting rolls mounted in the roll cassette are operational in the caster. A casting roll guide is adapted to enable the transfer of the casting rolls mounted in the roll cassette between the set up station and the transfer station, and between the transfer station and the casting position. The casting rolls mounted in a roll cassette may be raised or lowered into the casting position.

The casting roll guides may comprise rails on which the casting rolls 12 mounted in the roll cassette 11 are capable of being moved between the set up station and the casting position through the transfer station. First rails 55 may extend between the set up station 47 to the transfer station 48, and second rails 56 may extend between the transfer station 48 to the casting position. The second rails 56 may extend to the casting position from either side of the casting position. Alternately, the second rails 56 may extend from the casting position in two directions with a second transfer station and a second setup station with rails corresponding to the first rail from both setup stations to the transfer station, such that the casting rolls 12 mounted in roll cassettes 11 may arrive in the casting position from either of two directions. Thus the casting roll guides may move casting rolls mounted in the roll cassette from either transfer station to the casting position at substantially the same elevation as the casting rolls when in the casting position. Alternately or in addition, the casting roll guides may move the casting rolls mounted in the roll cassette from the set up station to the transfer station at substantially the same elevation or different elevations. In one alternate, the first rails 55 are at a different elevation than the second rails 56, and the transfer station 48 may move between the different elevations to move casting rolls 12 mounted in roll cassettes 11 between the first rails 55 and second rails 56.

In any case, the casting roll guides may be, if needed, enable locking engagement of the positioning assemblies 50, 51 with the roll cassette 11 on the casting roll guides. In one embodiment, the roll cassette 11 may include wheels 54 capable of supporting and moving the roll cassette on the rails 55, 56. As shown in FIGS. 3 and 7, the wheels 54 may have a portion that engages the rail to enable to the wheel to stay on the rail. Alternately or in addition, the rail may have a portion that engages the wheel to enable the wheel to stay on the rail.

The casting roll guides may include a propulsion system (not shown) capable of moving the roll cassette 11 along the rails 55, 56. Additionally, the roll cassette 11 may include at least a portion of the propulsion system capable of moving the roll cassette 11, the portion capable of driving the wheels 54 or capable of cooperating with a corresponding portion of the propulsion device of the casting roll guide. The propulsion system may include, for example, cog and drive chain, pulley and cable, drive screw and screw jack, rack and pinion, linear actuators, hydraulic or pneumatic cylinders, hydraulic or pneumatic actuators, electric motors, or other devices capable of moving the roll cassette 11 along the rails 55, 56.

The casting rolls mounted in the roll cassette are capable of being prepared for casting at the set up station 47. Initial casting roll position on the roll cassette and other adjustments may be made when the casting rolls are prepared for casting. The set up station 47 may be position on the first rails 55. Alternately, the set up station 47 may be separate from the first rails 55 and at the same or a different elevation than the first rails 55.

As shown in FIGS. 2 and 8, the transfer station 48 may include a turntable 58. Both first and second rails 55, 56 may be capable of being aligned with rails on the turntable 58 of the transfer station such that the turntable 58 may be turned to exchange casting rolls mounted in roll cassettes between the first rails 55 and the second rails 56. The turntable 58 may rotate about a center axis, as indicated by arrow "A" in FIG. 8, to transfer a roll cassette from one set of rails to another. As shown in FIG. 8, the turntable 58 may include at least two rail portions, each capable of holding a set of casting rolls mounted a roll cassette and each aligned with a set of rails 55, 56 extending there from, such that when the turntable rotates about its central axis, the casting rolls mounted on the roll cassettes on the turntable move from being aligned with one set of rails to another.

Thus the turntable 58 shown in FIG. 8 is generally configured to transfer two sets of casting rolls mounted on roll cassettes at the same time, but the transfer station may be configured to be capable of transferring three, or more sets of casting rolls mounted in roll cassettes as desired to service one or more twin roll casters at the same time. For example, the transfer station 48 may include a shifting platform (not shown) where both first and second rails 55, 56 may be capable of being aligned with rails on the shifting platform. In this event, the shifting platform may then translate horizontally, vertically, or laterally to move casting rolls mounted in roll cassettes between the first rails 55 and the second rails 56.

To reduce change-over time, a roll cassette 11 with casting rolls 12 prepared for casting can be moved from the set-up station to the transfer station 48 before or during the time casting of molten metal is stopped for the roll change-over. In this way, the change-over time may include the time required to move the discharged casting rolls mounted on roll cassette from the casting position to the transfer station, the time to exchange casting rolls at the transfer station, and the time to move the prepared casting rolls from the transfer station to the casting position.

The transfer station 48 may be used in a method of changing casting rolls in the twin roll caster in which the casting roll guides is a set of rails, including steps of: assembling in a first pair of counter-rotatable casting rolls 12 mounted in a roll cassette 11, preparing the first casting rolls mounted in the roll cassette for casting at the set up station 47, moving the first casting rolls mounted in the roll cassette to a transfer station 48, exchanging at the transfer station 48 the first casting rolls mounted on roll cassette 11 with a second set of casting rolls mounted in a second roll cassette 11', moving the first casting rolls mounted in a roll cassette 11 from the transfer station to casting position where the pair of counter-rotatable casting rolls are positioned for casting thin strip, and moving the second casting rolls mounted in a second roll cassette 11' from the transfer station to the set up station where the second casting rolls mounted in the roll cassette 11' can be changed (i.e., replaced, refurbished, or repaired).

The twin roll caster may be capable of a rapid change of the scrap receptacle 26. During operation, the scrap receptacle 26 may fill with various materials from the casting operation and require changing. As discussed above, the scrap receptacle 26 may sealingly engage the enclosure 27 to support the protective atmosphere immediately beneath the casting rolls in the casting position. In some operations, it may be desirable to minimize the loss of the protective atmosphere when a full scrap receptacle is replaced with an empty scrap receptacle, and in others, it may be desirable to continue the casting operation during change out of the scrap receptacles 21.

Figure 9:
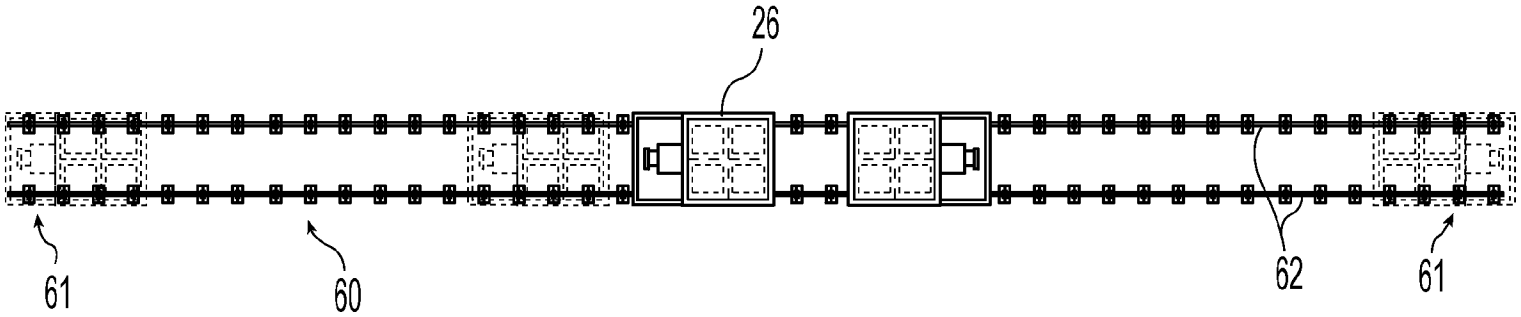
FIG. 9 is a diagrammatical plan view of a scrap receptacle guide.

The scrap receptacle 26 may be capable of being positioned beneath the casting rolls in the casting position and movable in either direction away from the casting position on a scrap receptacle guide 60 to scrap discharge stations 61. Each scrap receptacle 26 is capable of attaching with the enclosure capable of supporting a protective atmosphere immediately beneath the casting rolls in the casting position. As shown in FIGS. 9 and 10, the scrap receptacle guide may be rails 62 extending in opposite directions from the casting position, the scrap receptacle rails 62 capable of supporting at least two scrap receptacles 26 movable along the rails from the casting position to the discharge stations 61. The scrap receptacle 26 may be mounted on a carriage 63 fitted with wheels that run on the scrap receptacle rails 62. The scrap discharge stations 61 are positioned adjacent the scrap receptacle rails 62 in each direction away from the caster. In this way, a full scrap receptacle can be moved in either direction away from the casting position to reach a scrap discharge station.

To reduce change-over time, the empty second scrap receptacle 26' may be positioned directly adjacent the scrap receptacle 26 that is in operation in preparation for the change-over before disengaging the scrap receptacle 26 from the enclosure. In this way, the second scrap receptacle 26' has a short distance to travel to the scrap receiving position when the first scrap receptacle is moved away and the time of change over can be reduced.

To reduce the amount of protective atmosphere that is lost and to reduce the amount of air entering the enclosure 27, a gas duct may be positioned capable of filling the second scrap receptacle 26 with a desired gas, such as but not limited to nitrogen, prior to being moved into the scrap receiving position.

The scrap receptacle rails 62 may be used in a method of changing scrap receptacles in the caster, including steps of: supporting first and second scrap receptacles 26, 26' movable along the scrap receptacle rails 62; sealingly engaging the first scrap receptacle 26 with an enclosure forming a protective enclosure beneath a pair of casting rolls; then disengaging the seal between the first scrap receptacle 26 and the enclosure 27 and moving the first scrap receptacle 26 along the scrap receptacle rails 62 in a direction away from the second scrap receptacle 26' to a discharge station 61; and moving the second scrap receptacle 26' into the casting position and sealingly engaging the second scrap receptacle and the enclosure 27. The method may also include the step of filling the second scrap receptacle 26' with a desired gas before moving the second scrap receptacle 26' into the casting position.

The movable tundish 14 may be provided with a distributor loading device to further enable a rapid change-over of the distributor in the twin roll caster. The twin roll caster includes a loading device capable of moving the distributor 16 from a stand-by position, or other desired location, to the casting position. The distributor stand-by position may be at an elevation lower than the position of the distributor in the casting position. To move the distributor into the casting position, at least a portion of the loading device may be overhead from the elevation of the distributor positioned in the casting position. As shown in FIGS. 11 and 12, the loading device may be at least one loading arm 78 movable with the movable tundish 14 on the tundish guide and capable of moving the distributor from the stand-by position and placing the distributor over the casting rolls in the casting position. Alternately, the loading device may be an overhead crane or other placement device.

In the embodiment of FIG. 12, two loading arms 78 may be positioned on the tundish car 66, capable of cooperatively moving the distributor 16 from a stand-by position 81 on a distributor shift car 80 and placing the distributor over the casting rolls 12 in the casting position, after the movable tundish 14 moves from the heating station 69 to the casting position. In the embodiment of FIG. 12, the stand-by position 81 is located beneath the tundish car 66 when the tundish car is in the casting position. The loading arms 78 may include an extendable arm 88 movably installed on the tundish car frame 71, and each loading arm 78 may have one or more clamps 89 capable of engaging the distributor 16. The clamps 89 may be clamps, locks, hooks, grips, or other suitable devices capable of engaging the distributor for moving the distributor. As shown in FIG. 11, each loading arm 78 may be movable on a trundle 82, which is movable on a frame member 67 and driven by a drive screw 83. A power cable 84 is provided to enable the loading arm 78 to move relative to the tundish car frame 71. Alternately, the moving device may be movable on a single frame member 67.

As shown in FIG. 12, a loading arm 78 may be positioned on each side of the tundish car 66, so that after the tundish car 66 is in the casting position, two extendable arms 88 may be extended to reach the distributor 16 in the stand-by position 81. The lifters 73, 74 may be used to raise the tundish 14 on the tundish car 66 to provide clearance for moving the distributor beneath the tundish car. Clamps 89 on each extendable arm 88 operatively engage the distributor 16, and the loading arms 78 lift the distributor 16 from the stand-by position 81 beneath the tundish car 66 and place the distributor over the casting rolls 12 in the casting position. Then, the clamps 89 may be disengaged and the extendable arms 88 retracted. The lifters 73, 74 may then lower the tundish 14 into position over the distributor 16 for casting.

As shown in FIGS. 1, 2 and 14, the distributor shift car 80 may be positioned adjacent the casting rolls in the casting position. The distributor shift car 80 is capable of supporting one or more distributors 16. The distributors 16 may be positioned on movable carriers 85. The carriers 85 may include wheels corresponding with rails on the shift car. Alternately, the carriers 85 may be movable on slides, or one or more shafts through apertures on the carrier, or another device capable of movably supporting the carriers 85 on the shift car 80. The shift car 80 further includes a propulsion system 87 operable connected to the carrier 85, such as a drive screw, hydraulic or pneumatic cylinder, or other drive mechanism, capable of moving a distributor prepared for casting into the stand-by position 81.

The shift car 80 may include one or more pre-heaters 86 to preheat the distributor 16 in preparation for casting. The pre-heaters 86 may be movable between an operable position and a clearance position, so that a distributor 16 can be moved from beneath the pre-heater to the stand-by position 81 when the pre-heater is in the clearance position. Alternately, the pre-heaters may have an operable position that provides clearance for the distributor 16 to be moved without moving the pre-heater.

The stand-by position 81 may be on the shift car 80 approximately in line with the location of the distributor in the casting position. In this way, the loading arms 78 may pick up the distributor and move it laterally to the casting position. The distributor 16 carries mounting brackets 41 for supporting the distributor on the caster frame when the distributor 16 is in the casting position.

In operation, the tundish car 66 may be used with a method including the steps of advancing the movable tundish 14 from the heating station 69 to the casting position; lifting the distributor 16 from the stand-by position 81 beneath the movable tundish and placing the distributor over the casting rolls 12 in the casting position; then, lowering the tundish 14 to an operable position over the distributor 16. The tundish car 66 may advance from the heating station 69 to the casting position until the tundish car 66 is over the distributor stand-by position 81. The movable tundish 14 may be in an elevated position on the tundish car 66. Then, two loading arms 78 cooperatively lift the distributor 16 from the stand-by position, move laterally along drive screws 83, and then place the distributor in the casting position. Then, the tundish 14 may be lowered into an operable position over the distributor 16. The ladle may begin filling the tundish before the step of lifting the distributor 16 from the stand-by position 81 beneath the movable tundish and placing the distributor over the casting rolls 12 in the casting position.

The tundish car 66 with loading arm 78 may reduce tundish change-over time by eliminating the need to use an overhead robot or other placement device for placing the distributor 16 and tundish 14 into the casting position. To reduce change-over time, a second tundish car 66' may be in the heating station 69 and the movable tundish 14 heated to a desired temperature before the casting of molten metal stops. Also, a second distributor 16' may be heated by a pre-heater 86 to preheat the distributor 16' to a desired temperature in preparation for casting. After casting stops, the loading arm picks up the distributor from the casting position, translates laterally along the drive screw 83 until the distributor is over the distributor shift car 80, and places the distributor on the carrier 85. Then, the first tundish car in the casting position moves to another heating station in the direction away from the second tundish car in its heating station. Then, the second tundish car 66' may advance from its heating station to the casting position. While the second tundish car 66' is moving into the casting position, the second distributor 16' may be moved from the pre-heater 86 to the stand-by position 81 in preparation for placement into the casting position. Alternately, the tundish car 66 may be replaced with the second tundish car 66' as described without a distributor change.

A ladle change typically may be made without stopping casting when the volume of molten metal in the tundish is sufficient to maintain casting during the time to remove the first tundish and positioning the second tundish in the casting position. The tundish change-over, however, may result in a break in casting when the volume of the distributor 16 does not hold an amount of molten metal needed to maintain casting during the time of the change-over. Similarly, a scrap receptacle change-over may be made without stopping casting.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of continuously casting steel strip comprising steps of:

providing rails positioned directly under a casting position and extending in opposite directions there from to discharge stations, supporting first and second scrap receptacles movable along the rails, engaging a seal between the first scrap receptacle and an enclosure enabling support of a protective atmosphere beneath a pair of casting rolls, disengaging the seal between the first scrap receptacle and the enclosure and moving the first scrap receptacle along the rails in a direction away from the second scrap receptacle to a discharge station, and moving the second scrap receptacle under the casting position and sealingly engaging the second scrap receptacle and the enclosure.

2. The method of continuously casting steel strip as claimed in claim 1 further comprising:

filling the second scrap receptacle with a desired gas before moving the second scrap receptacle into the casting position.

3. The method of continuously casting steel strip as claimed in claim 1 further comprising:

adapting a casting roll guide to enable the transfer of casting rolls mounted in roll cassettes between a set up station and a transfer station, and between the transfer station and the casting position, preparing a first pair of counter-rotatable casting rolls mounted in a roll cassette for casting at the set up station, moving the first pair of counter-rotatable casting rolls mounted in the roll cassette from the set up station to the transfer station, exchanging at the transfer station the first casting rolls mounted in the roll cassette with second casting rolls mounted in a second roll cassette, moving the first casting rolls mounted in the roll cassette from the transfer station to the casting position where the first pair of counter-rotatable casting rolls are positioned for casting thin strip, and moving the second casting rolls mounted in the second roll cassette from the transfer station to the set up station where the second casting rolls mounted in the second roll cassette can be changed.

4. The method of continuously casting steel strip as claimed in claim 3 further comprising:

moving a movable tundish, which is adapted to receive molten metal and transferring the molten metal to a casting pool through a distributor and a core nozzle, from a heating station to the casting position by a tundish guide elevated above the movement of the first and second casting rolls mounted in roll cassettes from the transfer station to the casting position.

5. The method of continuously casting steel strip as claimed in claim 4 where the tundish guide comprises rails extending between the heating station and the casting position.

6. The method of continuously casting steel strip as claimed in claim 4, further comprising:

providing a loading device with the movable tundish adapted to lift the distributor from a stand-by position and placing the distributor over the first pair of counter-rotatable casting rolls in the casting position, the loading device elevated above the movement of the first and second casting rolls, advancing the movable tundish from the heating station to the casting position; and moving the distributor from the stand-by position and placing the distributor over the first pair of counter-rotatable casting rolls in the casting position.

7. The method of continuously casting steel strip as claimed in claim 4, further comprising:

providing two loading arms with the movable tundish adapted to cooperatively move the distributor from a stand-by position and placing the distributor over the first pair of counter-rotatable casting rolls in the casting position, the loading arms elevated above the movement of the first and second casting rolls mounted in roll cassettes, advancing the movable tundish from the heating station to the casting position; and moving the distributor from the stand-by position below the movable tundish and placing the distributor over the first pair of counter-rotatable casting rolls in the casting position.

8. The method of continuously casting steel strip as claimed in claim 2 further comprising:

moving a movable tundish, which is adapted to receive molten metal and transferring the molten metal to a casting pool through a distributor and a core nozzle, from a heating station to the casting position by a tundish guide elevated above the casting rolls in the casting position.

9. The method of continuously casting steel strip as claimed in claim 7 where the tundish guide comprises rails extending to heating stations in either direction away from the casting position.

10. The method of continuously casting steel strip as claimed in claim 9 further comprising:

preparing a second movable tundish, which is adapted to receive molten metal and transferring the molten metal to the casting pool through the distributor and the core nozzle, at one heating station;

moving the movable tundish from the casting position along the rails in a direction away from the second movable tundish to another heating station; and moving the second movable tundish to the casting position along the rails.

* * * * *